US011612928B2

(12) United States Patent
Kang et al.

(10) Patent No.: US 11,612,928 B2
(45) Date of Patent: Mar. 28, 2023

(54) APPARATUS AND METHOD FOR MANUFACTURING CONTAINER UPPER PLATE INCLUDING HANDLE COUPLED THERETO

(71) Applicants: FREE CAN CO., LTD., Chungcheongbuk-do (KR); SHANGHAI MINSHENG INTERNATIONAL TRADING CO., LTD., Shanghai (CN); Yong Je Kang, Busan (KR); Mi Jung Pyo, Sejong-si (KR)

(72) Inventors: Yong Je Kang, Busan (KR); Young Hyun Kim, Daejeon (KR)

(73) Assignees: FREE CAN CO., LTD., Chungcheongbuk-do (KR); Shanghai Minsheng International Trading Co., Ltd., Shanghai (CN); Yong Je Kang, Busan (KR); Mi Jung Pyo, Sejong-si (KR)

( * ) Notice: Subject to any disclaimer, the term of this patent is extended or adjusted under 35 U.S.C. 154(b) by 302 days.

(21) Appl. No.: 16/763,621

(22) PCT Filed: Apr. 5, 2018

(86) PCT No.: PCT/KR2018/004028
§ 371 (c)(1),
(2) Date: May 13, 2020

(87) PCT Pub. No.: WO2019/093601
PCT Pub. Date: May 16, 2019

(65) Prior Publication Data

US 2020/0276629 A1 Sep. 3, 2020

(30) Foreign Application Priority Data

Nov. 13, 2017 (KR) ..... 10-2017-0150389

(51) Int. Cl.
*B21D 39/02* (2006.01)
*B21D 51/44* (2006.01)

(52) U.S. Cl.
CPC ..... *B21D 39/02* (2013.01); *B21D 51/44* (2013.01)

(58) Field of Classification Search
CPC ..... B21D 39/02; B21D 51/44; B21D 39/032; B65D 25/28
See application file for complete search history.

(56) References Cited

U.S. PATENT DOCUMENTS 1,617,493 A * 2/1927 Miller ..... B65D 25/2858 220/768
5,637,167 A * 6/1997 Krishnakumar .... B29C 65/3644 215/396

(Continued)

FOREIGN PATENT DOCUMENTS

JP 2006123973 A 5/2006
KR 200440934 Y1 7/2008

(Continued)

*Primary Examiner* — Sarang Afzali
*Assistant Examiner* — Darrell C Ford
(74) *Attorney, Agent, or Firm* — Rabin & Berdo, P.C.

(57) ABSTRACT

An apparatus and method for manufacturing a container upper plate including a handle coupled thereto are disclosed. The apparatus includes a steel-plate-shaping unit for forming at least one projection on an upper surface of a steel plate, a holding-plate-supply unit for supplying a holding plate including a reception portion, and a mounting portion bilaterally extending from the reception portion and coupled to the steel plate, the mounting portion having at least one groove or at least one hole formed therein, to the steel-plate-shaping unit, a loading unit for loading the holding plate onto the steel plate such that the at least one projection on the steel plate is fitted into the at least one groove or the at least one hole, and a coupling unit for coupling the holding (Continued)

plate to the steel plate by pressing a fitted portion by means of a press plate.

11 Claims, 17 Drawing Sheets

(56) References Cited

U.S. PATENT DOCUMENTS

| | | | | |
|---|---|---|---|---|
| 2003/0148050 | A1* | 8/2003 | Taniguchi | B29C 49/20 264/516 |
| 2004/0129703 | A1* | 7/2004 | Rieck | B65D 17/401 220/258.1 |
| 2004/0222651 | A1* | 11/2004 | Le | B65G 7/12 294/15 |
| 2007/0262047 | A1 | 11/2007 | Agrawal et al. | |
| 2011/0147382 | A1* | 6/2011 | Mitchell | B21D 19/088 220/270 |
| 2014/0166677 | A1* | 6/2014 | Flanagan-Kent | B65D 25/2867 220/661 |
| 2019/0060977 | A1* | 2/2019 | Macke | B21D 22/04 |

FOREIGN PATENT DOCUMENTS

| | | | |
|---|---|---|---|
| KR | 1020100125050 | A | 11/2010 |
| KR | 1020140064177 | A | 5/2014 |

* cited by examiner (a)

(b)

(a)

(b)

(a)

(b)

(c)

(a)

(b)

(a)

(b)

(c)

APPARATUS AND METHOD FOR MANUFACTURING CONTAINER UPPER PLATE INCLUDING HANDLE COUPLED THERETO

TECHNICAL FIELD

The present invention relates to an apparatus and method for manufacturing a container upper plate including a handle coupled thereto, and more particularly to an apparatus and method for manufacturing a container upper plate including a handle coupled thereto, which couple the handle to the container upper plate without using welding or an adhesive, thereby preventing corrosion or damage to the upper plate and improving the efficiency of the manufacturing process.

BACKGROUND ART

Containers are differently used according to the intended application. For example, containers are configured to contain and store therein contents such as industrial oil, cooking oil, drugs, powder and the like. Generally, the liquid or powder contained in a container is discharged through the discharge spout of the container. A cap is openably coupled to the discharge spout of the container.

FIGS. 1 and 2 illustrate such a conventional container.

FIG. 1 is a perspective view of the conventional container. (a) in FIG. 2 illustrates an upper plate of the conventional container, to which a handle is coupled, and (b) in FIG. 2 illustrates the coupling region of the upper plate, from which the handle is removed.

As illustrated in FIGS. 1 and 2, the conventional container 10 includes a body having a square column shape. The upper plate 12 of the container 10 is provided at a predetermined location thereof with a discharge spout 14, which is also used to introduce content into the container. The upper plate 12 is provided at the center thereof with a handle 16, which is coupled to the upper plate 12 by means of a holding plate 18 so as to enable the container to be carried by a user.

The handle 16 is composed of a grip portion 16*a* and a fitting portion 16*b* fitted into the holding plate 18. The holding plate 18 is composed of a reception portion 18*a*, into which the fitting portion 16*b* of the handle 16 is fitted, and a mounting portion 18*b* bilaterally extending from the reception portion 18*a* and coupled to the upper plate 12.

As a process of manufacturing the container upper plate 12 including the handle 16 coupled thereto, a process of coupling the holding plate 18 including the handle 16 fitted thereinto to the upper plate 12 through welding such as spot-welding in the state in which the mounting portion 18*b* of the holding plate 18 is in contact with the upper surface of the upper plate 12 is predominantly used.

However, the conventional coupling process has a problem in that the welded portion of the upper plate 12 of the container 10 is damaged. Typically, the upper plate 12 is made of a tin-plated steel plate. In the case of coupling through welding, there is a problem in that the tin-plated portion is damaged and the welded portion 19 corrodes during the welding process, as illustrated in FIG. 2. Furthermore, in the case in which the holding plate 18 is coupled to the upper plate 12 through a spot-welding process and liquid or powder having a relatively high weight is stored in the container, there is a problem in that coupling force of the welded portion decreases and thus the handle 16 becomes separated from the upper plate.

DISCLOSURE

Technical Problem

Therefore, the present invention has been made in view of the above problems, and it is an object of the present invention to provide an apparatus and method for manufacturing a container upper plate including a handle coupled thereto, which is capable of overcoming the above conventional problems.

It is another object of the present invention to provide an apparatus and method for manufacturing a container upper plate including a handle coupled thereto, which increases the coupling force with the handle and facilitates the manufacture thereof.

It is a further object of the present invention to provide an apparatus and method for manufacturing a container upper plate including a handle coupled thereto, which is capable of preventing damage to the upper plate or corrosion of the upper plate.

It is still a further object of the present invention to provide an apparatus and method for manufacturing a container upper plate including a handle coupled thereto, which facilitates coupling of the handle with the upper plate and improves process efficiency.

The objects of the present invention are not limited to the above disclosure, and other objects of the present invention, which are not mentioned above, will be apparent to those skilled in the art from the following disclosure.

Technical Solution

In accordance with an aspect of the present invention, some of the above objects can be accomplished by the provision of a method of manufacturing a container upper plate including a handle coupled thereto including a preparation operation of preparing a steel plate having a predetermined shape, a handle including a grip portion and a fitting portion, and a holding plate including a reception portion into which the fitting portion of the handle is fitted and a mounting portion extending bilaterally from the reception portion and coupled to the steel plate, a steel-plate-shaping operation of forming at least one projection, which projects upwards from a coupling region of the steel plate to which the mounting portion is coupled, on the steel plate, thereby shaping the steel plate, a loading operation of loading the holding plate onto the steel plate such that the at least one projection on the steel plate is fitted into at least one groove or hole formed in the mounting portion, and a coupling operation of coupling the holding plate to the steel plate under pressure by pressing a fitted portion, at which the at least one projection is fitted into the at least one groove or hole, from above and underneath.

The at least one groove may have an inside width or an inside diameter equal to or larger than an outside width or an outside diameter of the at least one projection.

The at least one groove may have a rectangular section having a constant inside width or inside diameter.

The at least one groove may have an inverted trapezoidal shape or an inverted triangular shape, an inside width or an inside diameter of which increases with increasing distance inwards from an inlet thereof.

The at least one groove or the at least one hole may be formed simultaneously with formation of the holding plate in the preparation of the holding plate, or may be formed through an additional shaping operation after the formation of the holding plate.

The method may further include, between loading of the holding plate and coupling of the holding plate, a side press operation of pressing a lower portion of the fitted portion from both lateral sides thereof in the state in which the at least one projection is fitted into the at least one groove or the at least one hole.

The steel-plate-shaping operation may include a preparation operation of preparing at least one lower metal mold, which includes at least one protrusion and is vertically movable, and an upper metal mold, which has at least one guide groove, into which the at least one protrusion is fitted, and is vertically movable, an initial shaping operation of disposing the steel plate between the upper metal mold and the lower metal mold and pressing the steel plate to form the at least one projection, in the state in which sizes of the protrusion and the guide groove are set to be larger than a desired size, an intermediate shaping operation of pressing the steel plate in the state in which the sizes of the protrusion and the guide groove are set to be smaller than those in the initial shaping operation but to be larger than the desired size, and a finish shaping operation of pressing the steel plate in the state in which the sizes of the protrusion and the guide groove are set to be equal to the desired size.

The steel-plate-shaping operation may be performed in stages between lower metal molds and upper metal molds in which the sizes of the protrusion on the lower metal molds and the guide groove in the upper metal molds are sequentially reduced.

The steel plate may be selected from among a tin-plated steel plate, a cold-rolled steel plate, a chrome-plated steel plate, a tin-plated steel plate coated with a protective film, a cold-rolled steel plate coated with a protective film and a chrome-plated steel plate coated with a protective film.

In accordance with another aspect of the present invention, some of the above objects can be accomplished by the provision of a method of manufacturing a container upper plate, to which a holding plate into which a handle is fitted is coupled, including fitting at least one projection formed on the upper plate into at least one groove or hole formed in the holding plate, and pressing the fitted portion to couple to the holding plate to the upper plate under pressure.

The at least one groove may have an inverted trapezoidal shape or an inverted triangular shape, an inside width or an inside diameter of which increases with increasing distance inwards from an inlet thereof.

Pressing of the fitted portion may include pressing a lower portion of the fitted portion from both lateral sides thereof in the state in which the at least one projection on the upper plate is fitted into the at least one groove or the at least one hole in the holding plate, and pressing the fitted portion from above and underneath.

In accordance with a further aspect of the present invention, some of the above objects can be accomplished by the provision of an apparatus for manufacturing a container upper plate including a steel-plate-shaping unit for forming at least one projection, which is configured to project upwards from an upper surface thereof and to be recessed from a lower surface thereof, on an upper surface of a steel plate having a predetermined shape, a holding-plate-supply unit for supplying a holding plate, which includes a reception portion, into which a handle is fitted, and a mounting portion bilaterally extending from the reception portion and coupled to the steel plate, the mounting portion having at least one groove or at least one hole formed therein, to the steel-plate-shaping unit, a loading unit for loading the holding plate onto the steel plate such that the at least one projection on the steel plate is fitted into the at least one groove or the at least one hole in the holding plate, and a coupling unit for coupling the holding plate to the steel plate under pressure by pressing a fitted portion, at which the at least one projection is fitted into the at least one groove or the at least one hole, by means of a press plate in the state in which the holding plate is loaded onto the steel plate.

The steel-plate-shaping unit may include at least one lower metal mold, which includes at least one protrusion and is vertically movable, and at least one upper metal mold, which has a guide groove, into which the at least one protrusion is fitted, and is vertically movable, wherein the at least one projection is formed on the upper surface of the steel plate by pressing the steel plate disposed between the lower metal mold and the upper metal mold by means of the lower and upper metal molds.

The steel-plate-shaping unit may perform shaping of the steel plate in stages between lower metal molds and upper metal molds in which the sizes of the protrusion on the lower metal molds and the guide groove in the upper metal molds are sequentially reduced.

The coupling unit may include a base plate configured to be vertically movable and a press plate configured to be vertically movable, wherein the holding plate is coupled to the steel plate under pressure by disposing the fitted portion between the base plate and the press plate and pressing the fitted portion from above and underneath.

The coupling unit may further include a side press unit for pressing a lower portion of the fitted portion from both lateral sides thereof.

Advantageous Effects

According to the present invention, which is constructed as describe above, since a container upper plate is manufactured through a press process without using additional adhesive, welding or the like, it is possible to overcome corrosion of the container upper plate or decrease in coupling force of the coupling upper plate, which is a problem with a welding process or the like, and there are advantages in that the coupling force between a handle and the upper plate is increased and the coupling therebetween is facilitated. Furthermore, it is possible to improve the process efficiency by efficiently disposing units of the apparatus to be adjacent to each other.

Effects of the present invention are not limited to the above and other effects of the present invention, which are not mentioned above, will be apparent to those skilled in the art from the following disclosure.

DESCRIPTION OF REFERENCE NUMERALS

Figure 1:
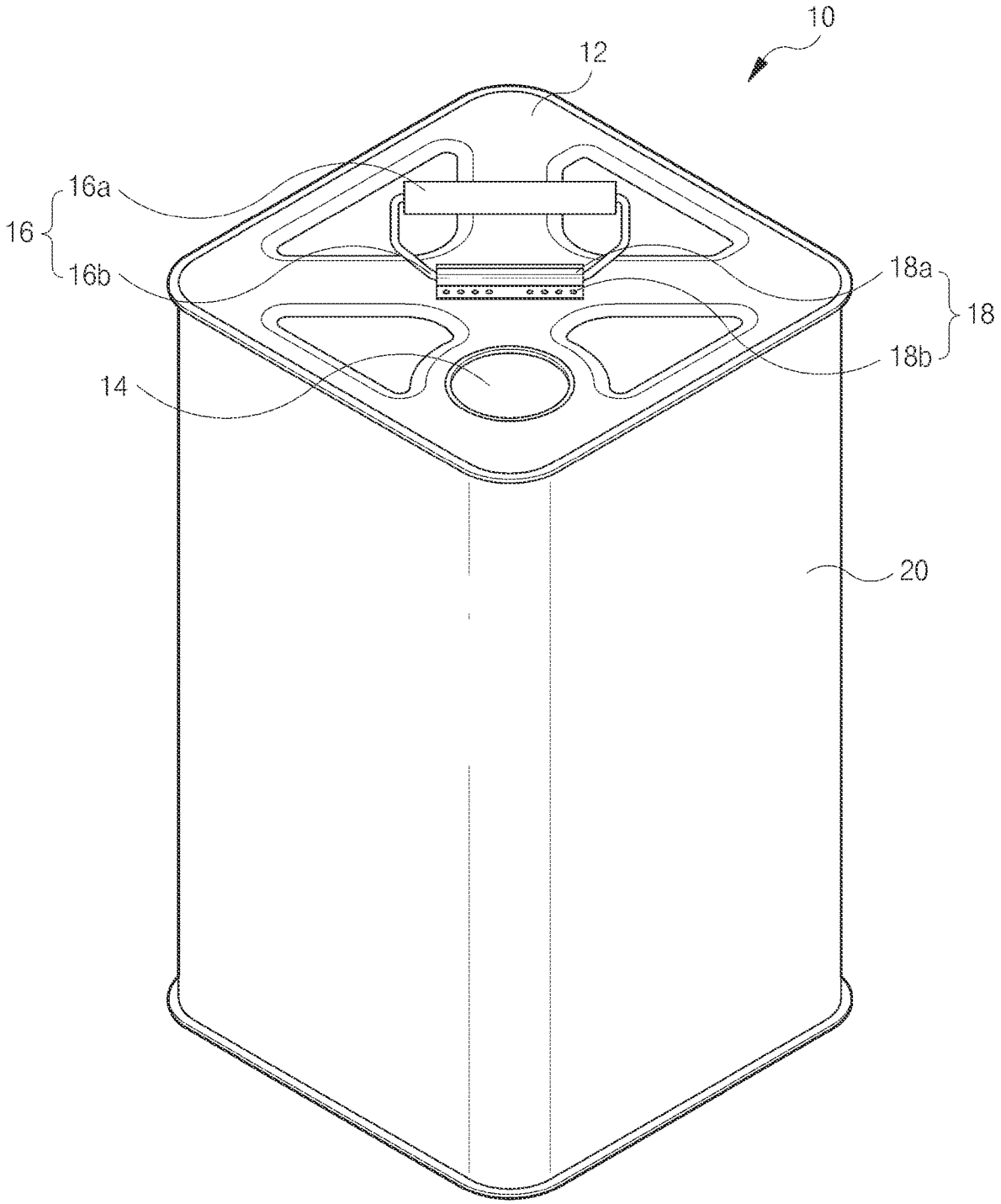
FIG. 1 (BACKGROUND ART)
FIG. 1 is a perspective view of a conventional container.
Figure 2:
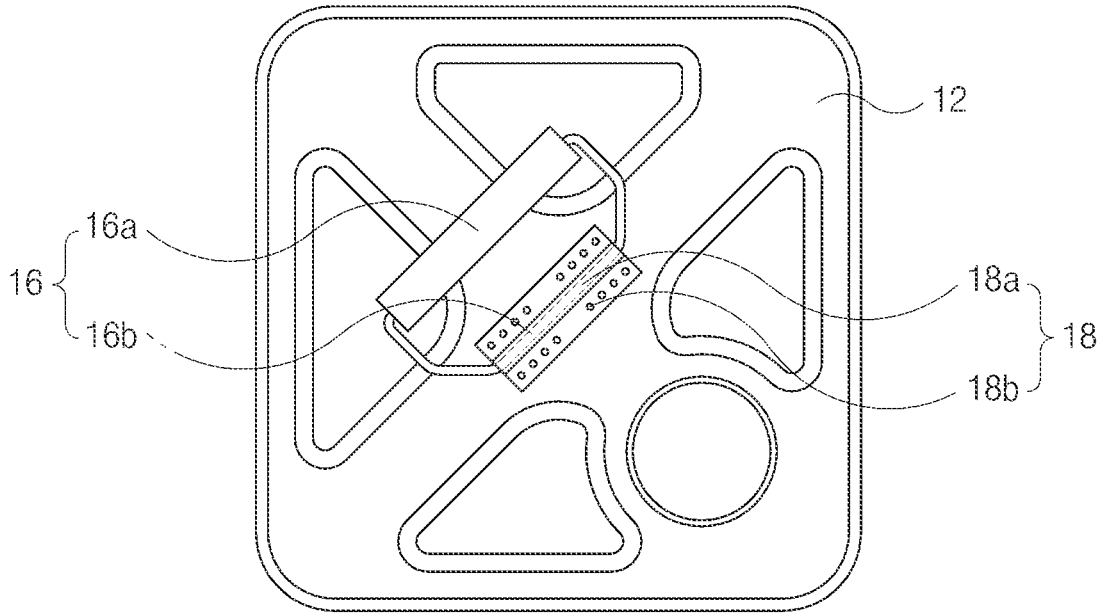
FIG. 2 (BACKGROUND ART)
FIG. 2 is illustrates the upper plate of the conventional container.
Figure 2:
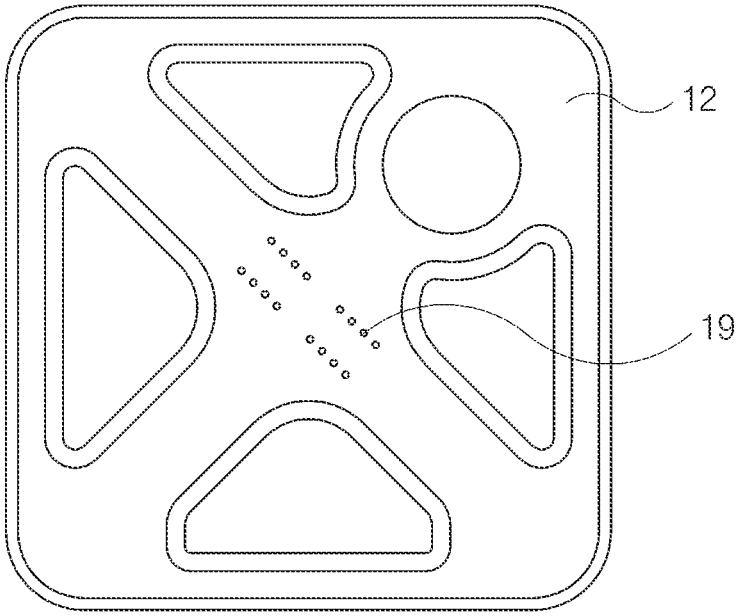
FIG. 2 (BACKGROUND ART)

110: Steel-plate-supply unit
120: Steel-plate-shaping unit
130: Holding-plate-supply unit
150: Loading unit
160: Coupling unit
210: Steel plate
215: Projection
220: Handle
230: Holding plate
235: Groove
235*a*: Hole

BEST MODE

Hereinafter, preferred embodiments of the present invention will be described with reference to the attached drawings so as to enable the embodiments to be easily understood by one of ordinary skill in the art to which this invention belongs. The present invention is not limited to the embodiments disclosed hereinafter, but may be embodied in different modes.

For the sake of clear description of the present invention, parts irrelevant to the description are omitted, and the same or equivalent components may be denoted by the same reference numbers throughout the specification.

In several embodiments, components having the same construction may be described with regard only to the representative embodiments using the same reference numbers, and, among components in other embodiments, only components that are different from those in the representative embodiment may be described.

In the entire specification, when an element is referred to as being "connected" to another element, it includes not only the case in which the element is "directly connected" to the another element but also the case in which the element is "indirectly connected" to the another element with a further element interposed therebetween. Furthermore, when an element is referred to as "including" another element, the element is intended to further include a further element rather than excluding the further element, unless the context clearly indicates otherwise.

Figure 3:
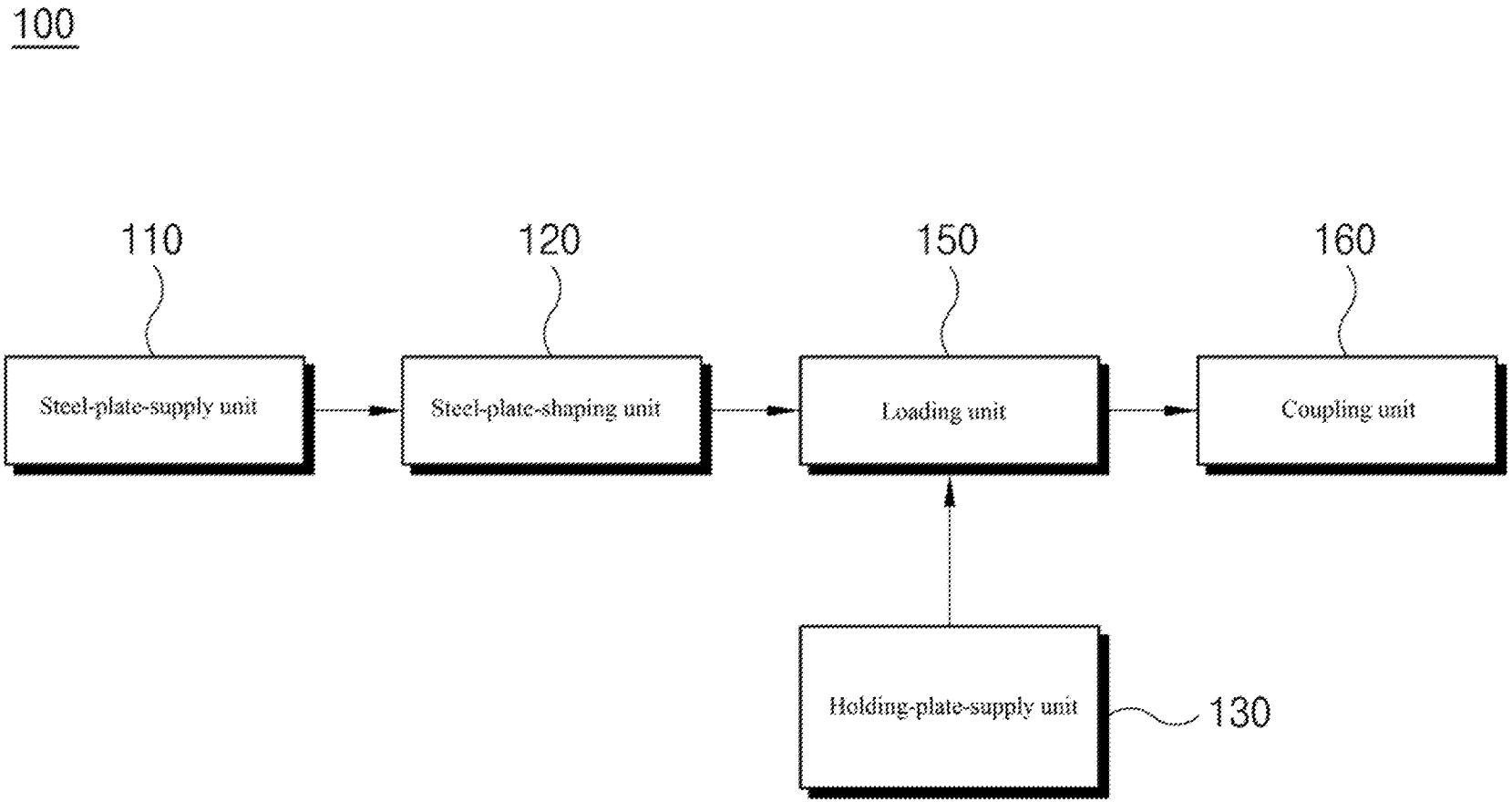
FIG. 3 is a block diagram of an apparatus for manufacturing a container upper plate according to an embodiment of the present invention.

FIG. 3 is a block diagram of an apparatus for manufacturing a container upper plate according to an embodiment of the present invention.

As illustrated in FIG. 3, the apparatus 100 for manufacturing a container upper plate according to the embodiment of the present invention includes a steel-plate-supply unit 110, a steel-plate-shaping unit 120, a holding-plate-supply unit 130, a loading unit 150, and a coupling unit 160. The apparatus may further include a holding-plate-shaping unit (not shown).

As illustrated in the drawing, the steel-plate-supply unit 110 is intended to supply a steel plate, which is cut into predetermined shape and size so as to correspond to that of a container upper plate, to the steel-plate-shaping unit 120. Although not shown in the drawing, the apparatus according to the present invention further includes a steel-plate-transfer unit (not shown). The steel-plate-transfer unit transfers a steel plate to the steel-plate-shaping unit 120, the loading unit 150 and the coupling unit 160 in that order. The steel-plate-transfer unit may transfer steel plates at regular intervals (pitches) using a conveyor belt, which is well known in the art, or may transfer steel plates using a robot arm or other transfer devices well known to those skilled in the art.

Although the steel plate may be selected from among a tin-plated steel plate, a cold-rolled steel plate, a chrome-plated steel plate, a tin-plated steel plate coated with a protective film, a cold-rolled steel plate coated with a protective film and a chrome-plated steel plate coated with a protective film, the present invention is not limited thereto. Furthermore, although the present invention may be applied not only to a steel plate but also to other metal plates such as aluminum plates, any of the various plates will be referred to as a "steel plate" for convenience of description.

The steel-plate-shaping unit 120 is intended to provide a steel plate, which is transferred from the steel-plate-supply unit 110, with at least one projection, which is configured to project from the upper surface thereof and to be recessed into the lower surface thereof.

Figure 4:
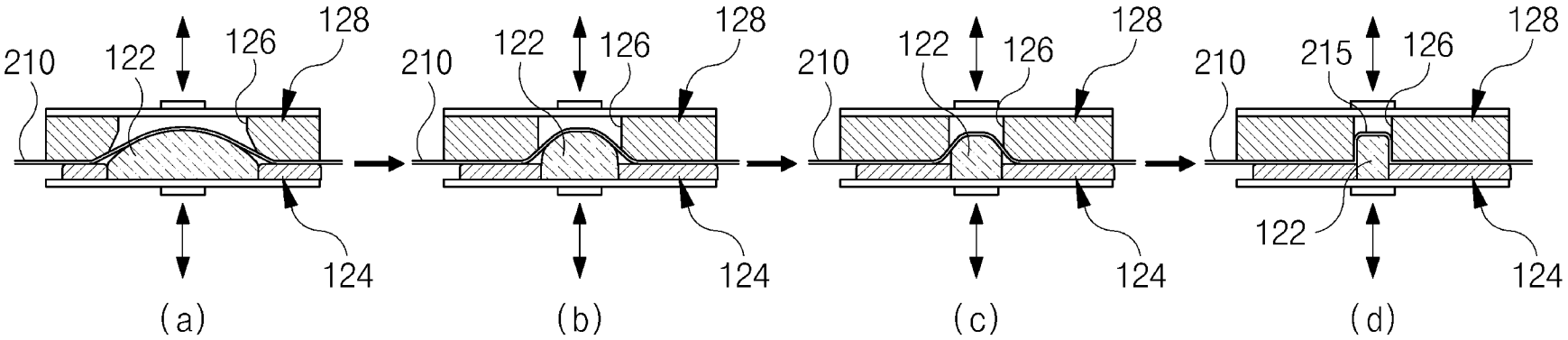
FIG. 4 is a schematic view illustrating an operation of shaping a steel plate by means of a lower steel-plate-shaping unit and an upper steel-plate-shaping unit.

The schematic structure of the steel-plate-shaping unit 120 and the operation of shaping the steel plate using the steel-plate-shaping unit 120 are schematically illustrated in FIG. 4.

As illustrated in FIG. 4, the steel-plate-shaping unit 120 includes at least one lower metal mold 124, which includes at least one protrusion 122 and is vertically movable, and at least one upper metal mold 128, which has at least one guide groove 126, into which the at least one protrusion 122 is fitted and which is vertically movable. A steel plate 210 is disposed between the upper metal mold 128 and the lower metal mold 124, and is shaped through pressing.

The number of protrusions 122 on the lower metal mold 124 is equal to the number of guide grooves 126 in the upper metal mold 128. The number and size of protrusions on the lower metal mold 124 may be appropriately controlled so as to correspond to the number and size of projections that are desired to be formed on the steel plate 210.

Each of the upper metal mold 128 and the lower metal mold 124 may include one metal mold or a plurality of metal molds. Although each of the upper metal mold 128 and the lower metal mold 124 is illustrated in the drawing as including four metal molds, the number of upper metal molds 128 and the number of lower metal molds 124 may be variously changed.

Considering the steel-plate-shaping unit 120 shown in FIG. 4, the steel-plate-shaping unit 120 may perform an operation of shaping the steel plate 210 through an initial shaping stage, an intermediate shaping stage and a finish shaping stage. The reason why the steel plate 210 is shaped through several shaping stages is to perform desired shaping without damaging the steel plate 210.

More specifically, after the lower metal mold 124 and the upper metal mold 128 are prepared, the initial shaping stage is performed as illustrated in (a) in FIG. 4. In the initial shaping stage, the shaping is performed through pressing in the state in which the size (width, diameter, length or the like) of the at least one protrusion 122 and the size (width, diameter, length or the like) of the guide groove 126 are controlled to be larger than the size of the projection 215 that is desired to be formed on the steel plate.

Subsequently, the intermediate shaping stage is performed as illustrated in (b) in FIG. 4. The intermediate shaping stage is performed in the state in which the sizes of the protrusion 122 and the guide groove 126 are controlled to be smaller than the sizes of the protrusion 122 and the guide groove 126 in the initial shaping stage but to be larger than the size of the desired projection 215. Subsequently, a second intermediate shaping stage is performed in the state in which the sizes of the protrusion 122 and the guide groove 126 are controlled to be smaller than the sizes in (b) in FIG. 4, as illustrated in (c) in FIG. 4. Finally, the finish shaping stage is performed in the state in which the sizes of the protrusion 122 and the guide groove 126 are controlled to correspond to the desired size of the projection 215, as illustrated in (d) in FIG. 4. As a result, the at least one projection 215 is formed on the steel plate 210, as illustrated in FIG. 5.

More specifically, the steel plate 210 is transferred to 'the position in (a)' by means of the steel-plate-transfer unit (not shown). When the steel plate 210 is transferred to 'the position in (a)', the upper metal mold 128 is lowered so as to be brought into close contact with the steel plate 210 by means of an actuator (not shown) configured to provide the upper metal mold 128 with vertical pushing force. Subsequently, the lower metal mold 124 is raised so as to shape the steel plate 210 by means of an actuator (not shown) configured to provide the lower metal mold 124 with vertical pushing force. After the shaping of the steel plate at 'the position in (a)' is completed, the upper metal mold 128 is raised, and the lower metal mold 124 is lowered, thereby releasing the close contact with the steel plate. Subsequently, the steel plate 210, which has been completely shaped at 'the position in (a)', is transferred to 'the position in (b)' by means of the steel-plate-transfer unit, and the steel plate 210 is further shaped at 'the position in (b)' in the same manner as the shaping at 'the position in (a)'. This shaping procedure is also repeatedly performed at 'the position in (c)' and 'the position in (d)', thereby completing the shaping operation. Through the shaping operation, it is possible to shape the steel pipe into a desired shape at high speed without damage to the steel plate.

As described above, the steel plate shaping 120 may include a plurality of upper metal molds and a plurality of lower metal molds in order to perform shaping of the steel plate in stages. Alternatively, the steel-plate-shaping unit 120 may include only the upper metal mold and the lower metal mold shown in (d) in FIG. 4 in order to perform shaping of the steel plate.

Figure 5:
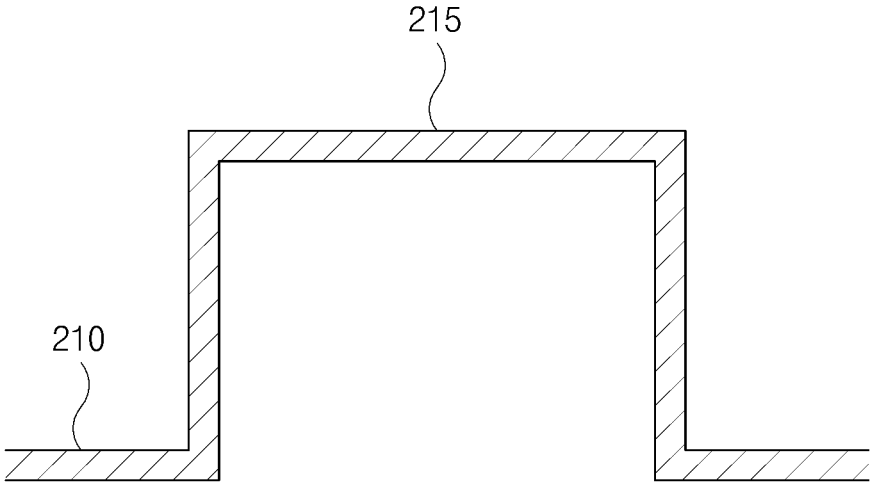
FIG. 5 is a cross-sectional view of at least one projection, which is formed by means of the steel-plate-shaping unit shown in FIG. 4.
Figure 5:
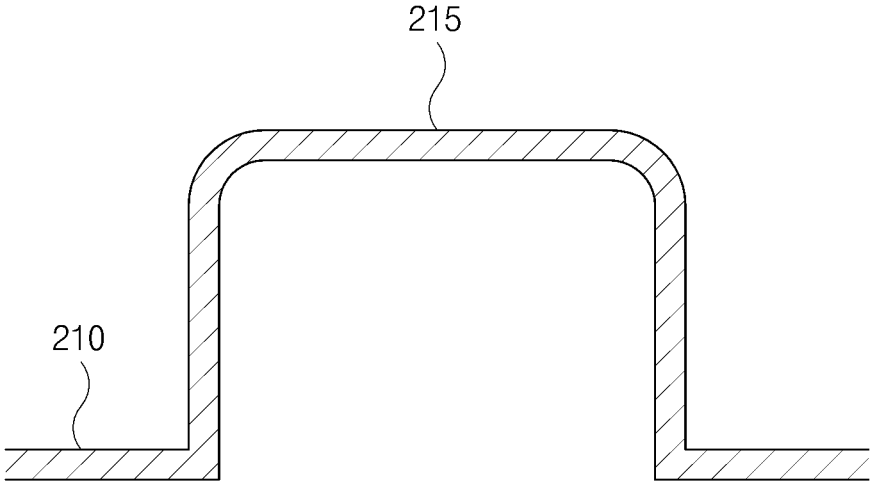

In FIG. 5, the number of projections 215 corresponds to the number of guide grooves 126 or protrusions 122, and the interval between the projections 215 corresponds to the interval between the guide grooves 126 or the protrusions 122.

The at least one projection 215 may project upwards from the steel plate 210 such that the lower surface thereof is recessed. The at least one projection 215 may be configured to have various shapes, such as a cylindrical shape and a polygonal column shape. The at least one projection 215 may be configured to have a rectangular section, in which the edges thereof are angled, as illustrated in (a) in FIG. 5, or in which the edges thereof are rounded, as illustrated in (b) in FIG. 5. In the case in which the edges thereof are rounded, the at least one projection 215 is easily fitted into the groove in the holding plate, which will be described later.

Figure 6:
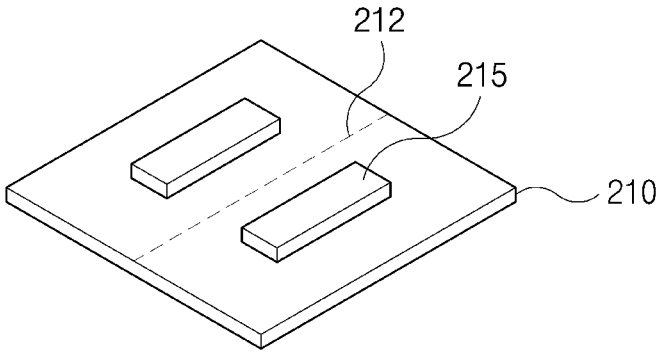
FIG. 6 illustrates perspective views of at least one projection, which is formed by means of the steel-plate-shaping unit shown in FIG. 4.
Figure 6:
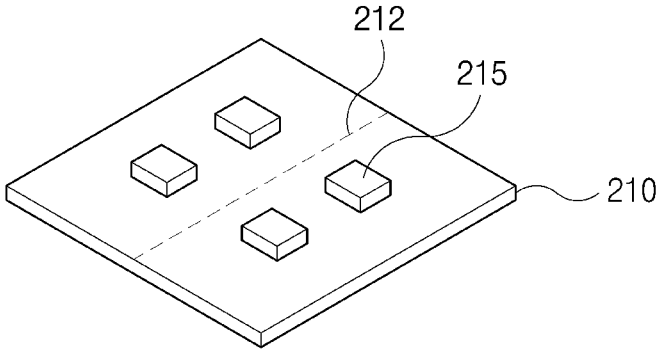
Figure 6:
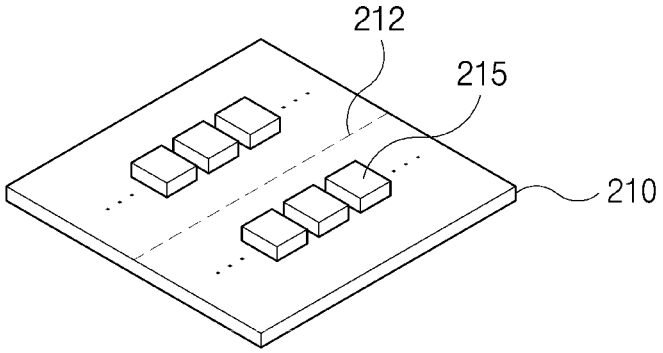

FIG. 6 is a perspective view illustrating examples of the at least one projections 215, formed by means of the steel-plate-shaping unit 120. The at least one projection 215 may include two projections, which are respectively located at both sides of a reference line 212, along which a fitting portion of a handle is fitted, and each of which is configured such that the length thereof is greater than the width thereof, as illustrated in (a) in FIG. 6. Alternatively, the at least one projection 215 may include four or more projections, which are arranged on both sides of the reference line 212 at regular intervals and each of which is configured to have the same or almost the same width and length, as illustrated in (b) and (c) in FIG. 6. Each of the projections may be configured to have various shapes and sizes.

Figure 7:
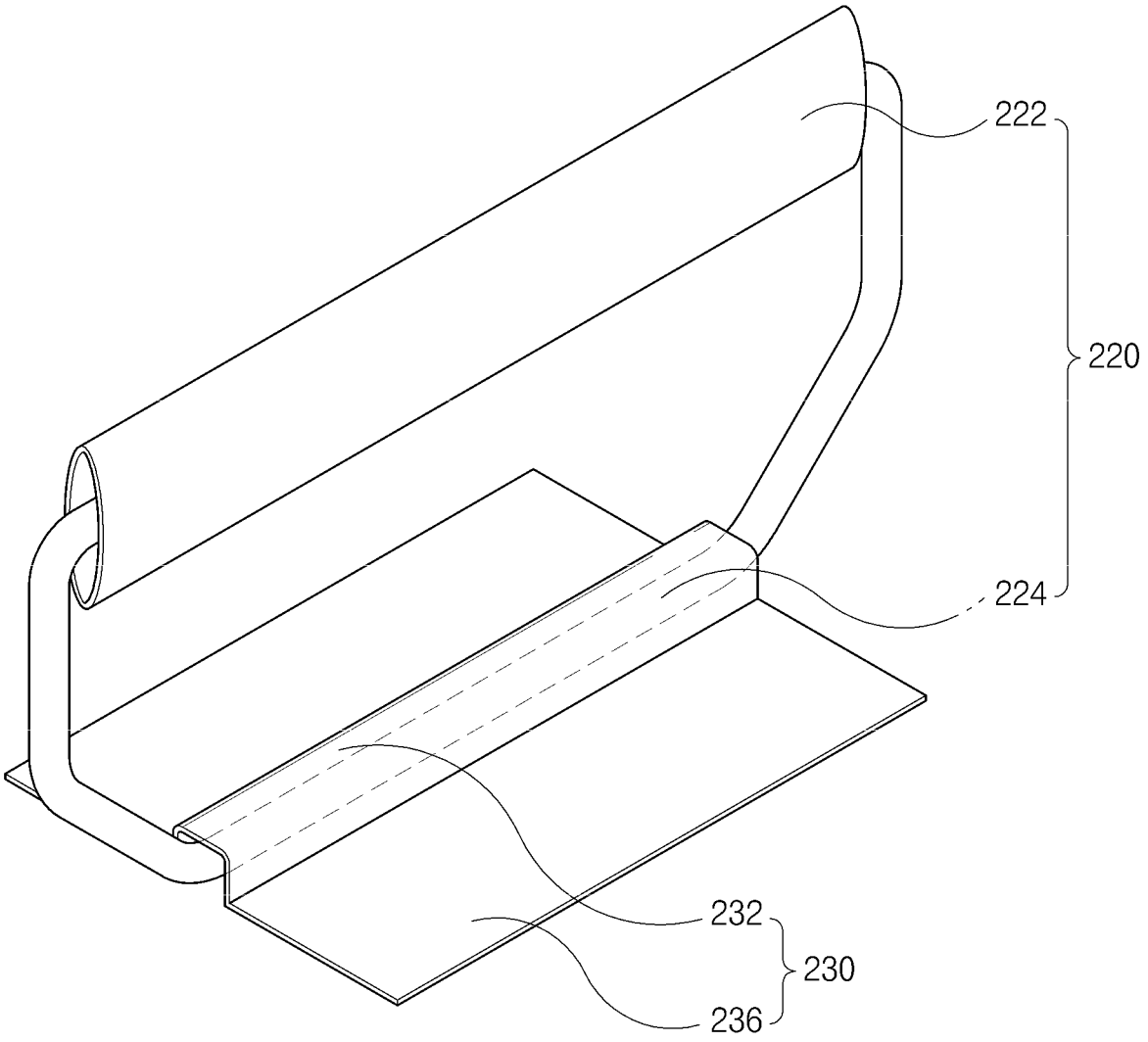
FIG. 7 is a perspective view illustrating the state of a holding plate, to which a handle is mounted, before a groove is formed in the holding plate.

The steel plate 210 is provided on the center line thereof with the handle unit 220 and 230 coupled thereto so as to allow the container according to the embodiment of the present invention to be carried. As illustrated in FIG. 7, the handle unit 220 and 230 is composed of the handle 220 and the holding plate 230. The handle 220 is composed of a grip portion 222 and a fitting portion 224 to be fitted into the holding plate 230, and the holding plate 230 is composed of a reception portion 232, into which the fitting portion 224 of the handle 220 is fitted, and a mounting portion 236, which bilaterally extends from the reception portion 232 and is mounted on the steel plate 210. The reception portion 232 has a space into which the fitting portion 224 is pivotably fitted, and the mounting portion 236 is configured to have a plate shape.

The holding plate 230 may be made of the same material as the steel plate 210 or may be made of a material different from that of the steel plate 210.

Figure 8:
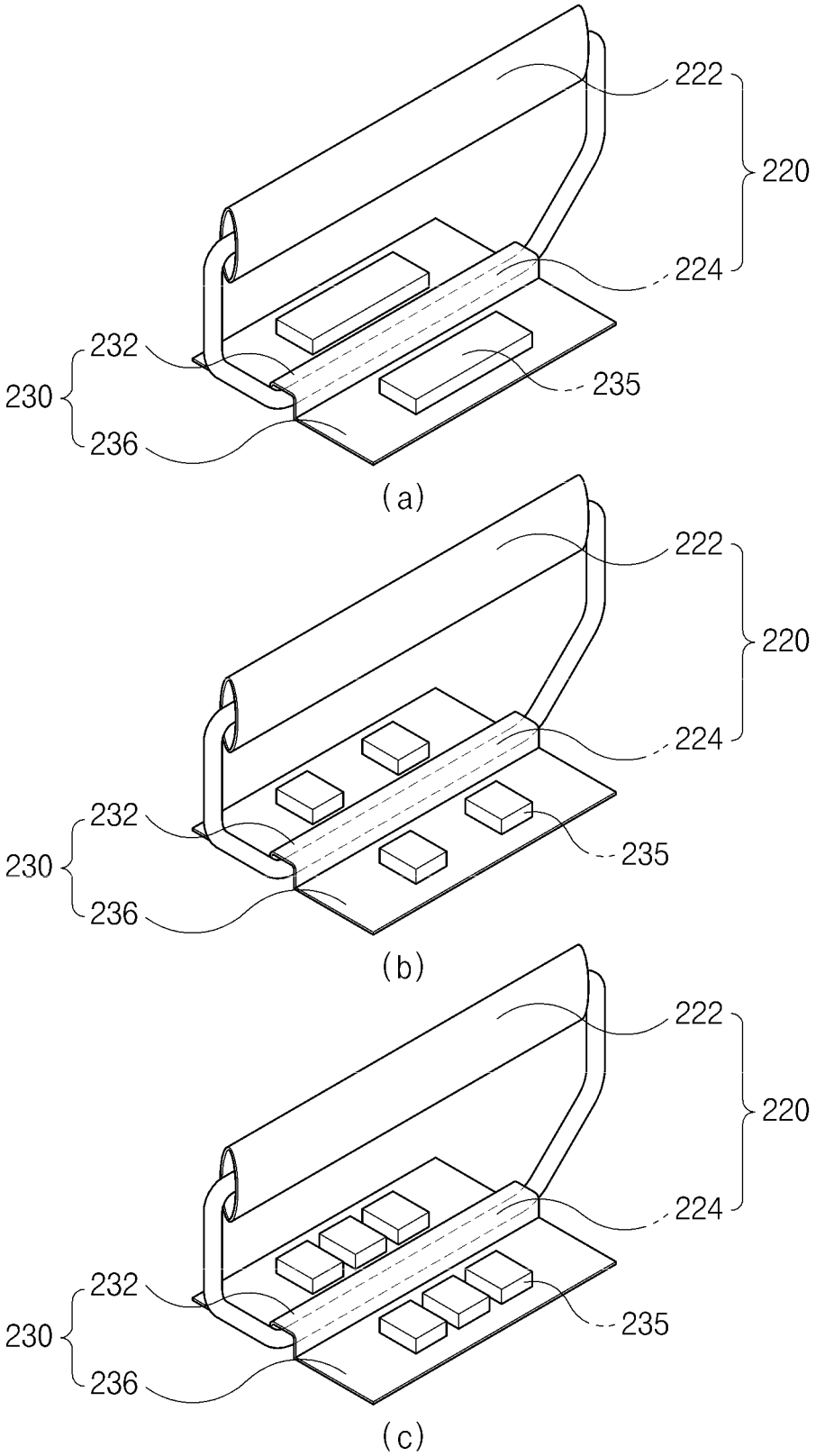
FIG. 8 illustrates perspective views of holding plates, each of which is provided therein with at least one groove.

The holding plate 230, which is to be coupled to the steel plate 210, must be configured such that the mounting portion 236 is provided with at least one groove 235 so as to correspond to the projection 215, as illustrated in FIG. 8. In the case in which the mounting portion 236 is not provided with the at least one groove 235, the holding plate 230 must be shaped by means of an additional holding-plate-shaping unit (not shown), thereby necessitating a procedure of forming the at least one groove 235. In other words, in the case in which the at least one groove 235 is not formed in the holding plate 230, as illustrated in FIG. 7, the at least one groove 235 must be formed by means of an additional holding-plate-shaping unit. Meanwhile, in the case in which the at least one groove 235 is also formed in the holding plate 230 in the initial operation of shaping the holding plate to have the reception portion 232 for receiving the handle 220, as illustrated in FIG. 8, there is no need to provide the holding-plate-shaping unit.

The holding-plate-shaping unit may be configured to have the same or almost the same structure as the steel-plate-shaping unit 120 so as to form the at least one groove 235 in the holding plate.

More specifically, the holding-plate-shaping unit is intended to form the at least one groove 235 (see FIG. 8), which projects upwards from the upper surface of the holding plate and is recessed into the lower surface of the holding plate, in the mounting portion 236 of the holding plate 230. The at least one groove 234 is distinguished from the at least one projection 215 formed on the steel plate 210. In order to form the at least one groove 235, the same operation as the shaping operation of forming the at least one projection 215 on the steel plate 210, described with reference to FIG. 4, may be applied.

The holding-plate-supply unit supplies the holding plate 210, in which the at least one groove 235 is formed, to the loading unit 150.

Since the at least one groove 235 is configured so as to project from the upper surface of the holding plate 230 and to be recessed into the lower surface of the holding plate 230, the at least one groove 235 has substantially the same structure as the at least one projection 215. However, the at least one groove 235 is referred to as the "groove" on the basis of the lower surface of the holding plate 230 because the at least one projection 215 is fitted into the at least one groove 235, and the at least one projection 215 is referred to as the "projection" on the basis of the upper surface of the steel plate 210 because the at least one projection 215 is fitted into the groove 235.

The at least one groove 235 is configured such that the number and position of the at least one groove 235 correspond to those of the at least one projection 215, and has a shape corresponding to the projection 215 such that the at least one projection 215 is fitted into the at least one groove 235.

FIG. 8 illustrates several examples of the at least one groove 235 formed in the holding plate 230. The at least one groove 232 may include two grooves, which are formed in both sides of the reception portion 232 of the holding plate 230, and each of which is configured such that the length thereof is greater than the width thereof, as illustrated in (a) in FIG. 8. In this case, the at least one groove 235 is configured to correspond to the at least one projection 215 shown in (a) in FIG. 6.

Alternatively, the at least one groove 235 may include four or more grooves, which are arranged at regular intervals and each of which is configured to have the same or almost the same width and length, as illustrated in (b) and (c) in FIG. 8. In this case, the at least one groove 235 is configured to correspond to the at least one projection 215, which has the shape shown in (b) and (c) in FIG. 6. The at least one groove 235 may be configured to have various shapes and sizes.

Here, the at least one groove 235 must be configured to have an inside width or an inside diameter equal to or larger than the outside diameter or the outside width of the at least one projection 215. When the inside width or the inside diameter of the at least one groove 235 is equal to the outside width or the outside diameter of the at least one projection 215, the at least one projection 215 must be forcibly fitted into the at least one groove 235 using strong force. In contrast, when the inside width or the inside diameter of the at least one groove 235 is larger than the outside width or the outside diameter of the at least one projection 215, the at least one projection 215 is easily fitted into the at least one groove 235.

Figure 9:
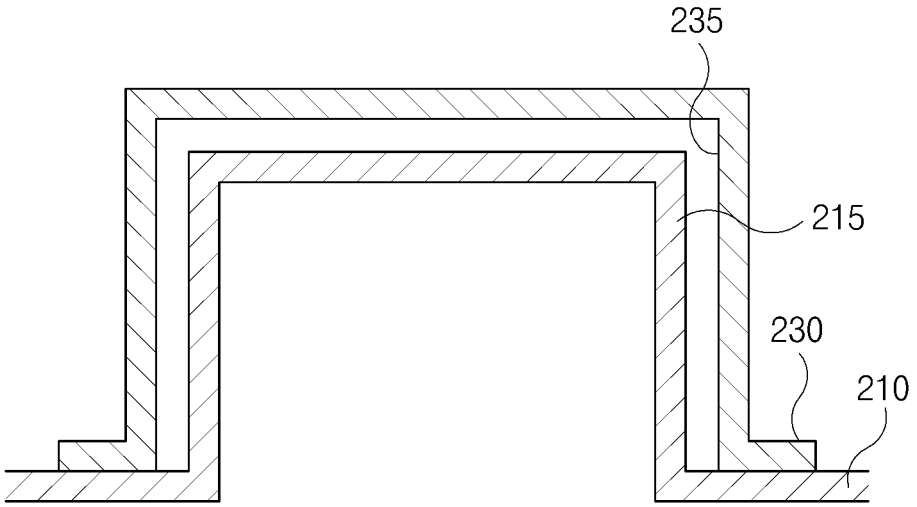
FIG. 9 illustrates cross-sectional views of fitted portions, at each of which a projection is fitted into a groove when a holding plate is loaded onto a steel plate.
Figure 9:
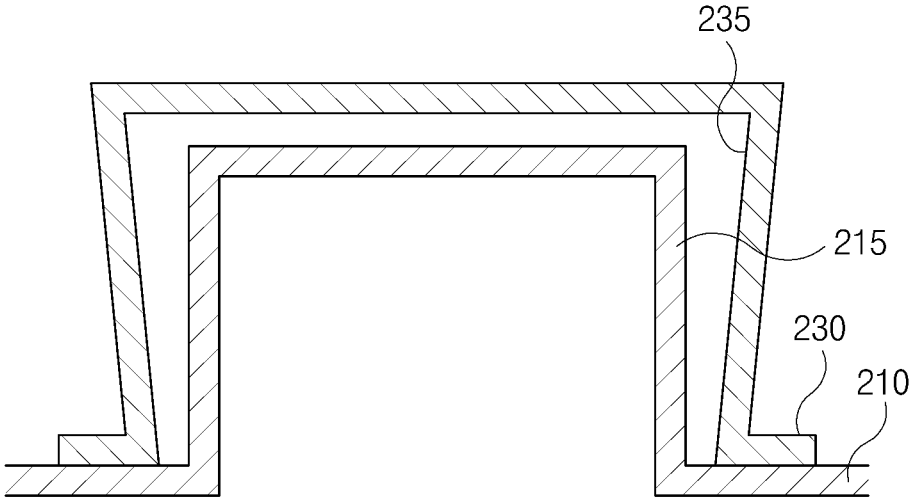

As illustrated in (a) in FIG. 9, the at least one groove 235 may be configured to have a rectangular section, which has a constant width or inside diameter, so as to correspond to the shape of the at least one projection 215.

Alternatively, as illustrated in (b) in FIG. 9, the at least one groove 235 may be configured to have an inverted trapezoidal shape or an inverted triangular shape, the width or the inside diameter of which increases with increasing distance inwards from the inlet. In this case, the at least one projection 215 may be configured to have a rectangular section having a constant width or inside diameter. In the case in which the at least one groove 235 and the at least one projection 215 are formed as illustrated in (b) in FIG. 9, the width or the inside diameter of the at least one groove 235 at the inlet thereof must be slightly larger than the width of the inside diameter of the at least one projection 215. Furthermore, in the case in which the at least one groove 235 and the at least one projection 215 are formed as illustrated in (b) in FIG. 9, when the at least one projection 215 and the at least one groove 235 are pressed in the state in which the at least one projection 215 is fitted into the at least one groove 235, it is possible to realize more secure coupling therebetween.

In the case in which the at least one groove 235 is formed simultaneously with the operation of shaping the holding plate 230 without forming the at least one groove 235 by means of an additional holding-plate-shaping unit, the above-mentioned structure may also be applied.

The loading unit 150 is intended to load the holding plate 230, including the at least one groove 235 formed therein, onto the steel plate 210, including the at least one projection 215 formed thereon.

When the handle 220 is mounted on the holding plate 230, the holding plate 230 including the handle 220 mounted thereon is loaded onto the steel plate 210. When the handle 220 is not previously mounted on the holding plate 230, the handle 220 is mounted on the holding plate 230 by fitting the fitting portion 224 into the reception portion 232, and the holding plate 230 is then loaded onto the steel plate 210.

The loading unit 150 may be embodied by an additional cassette apparatus or robot arm. Furthermore, the loading unit 150 may be embodied by an additional gripping device or loading device.

As illustrated in (a) and (b) in FIG. 9, the loading unit 150 loads the holding plate 230 onto the steel plate 210 such that the at least one projection 215 formed on the steel plate 210 is fitted into the at least one groove 235 formed in the holding plate 230. Here, an additional support unit, which is configured to grip the handle 220, may be further provided so as to prevent the handle 220 from impeding the loading of the holding plate 230. Furthermore, when the holding plate 230 is coupled to the steel plate 210 through pressing by means of the coupling unit 160, which will be described later, the support unit may also support the handle 220 to prevent the handle 220 from impeding the pressing coupling.

The coupling unit 160 is intended to couple the holding plate 230 to the steel plate 210 through pressing in the state in which the holding plate 230 is loaded onto the steel plate 210 by means of the loading unit such that the at least one projection 215 formed on the steel plate 210 is fitted into the at least one groove 235 formed in the holding plate 230.

Figure 10:
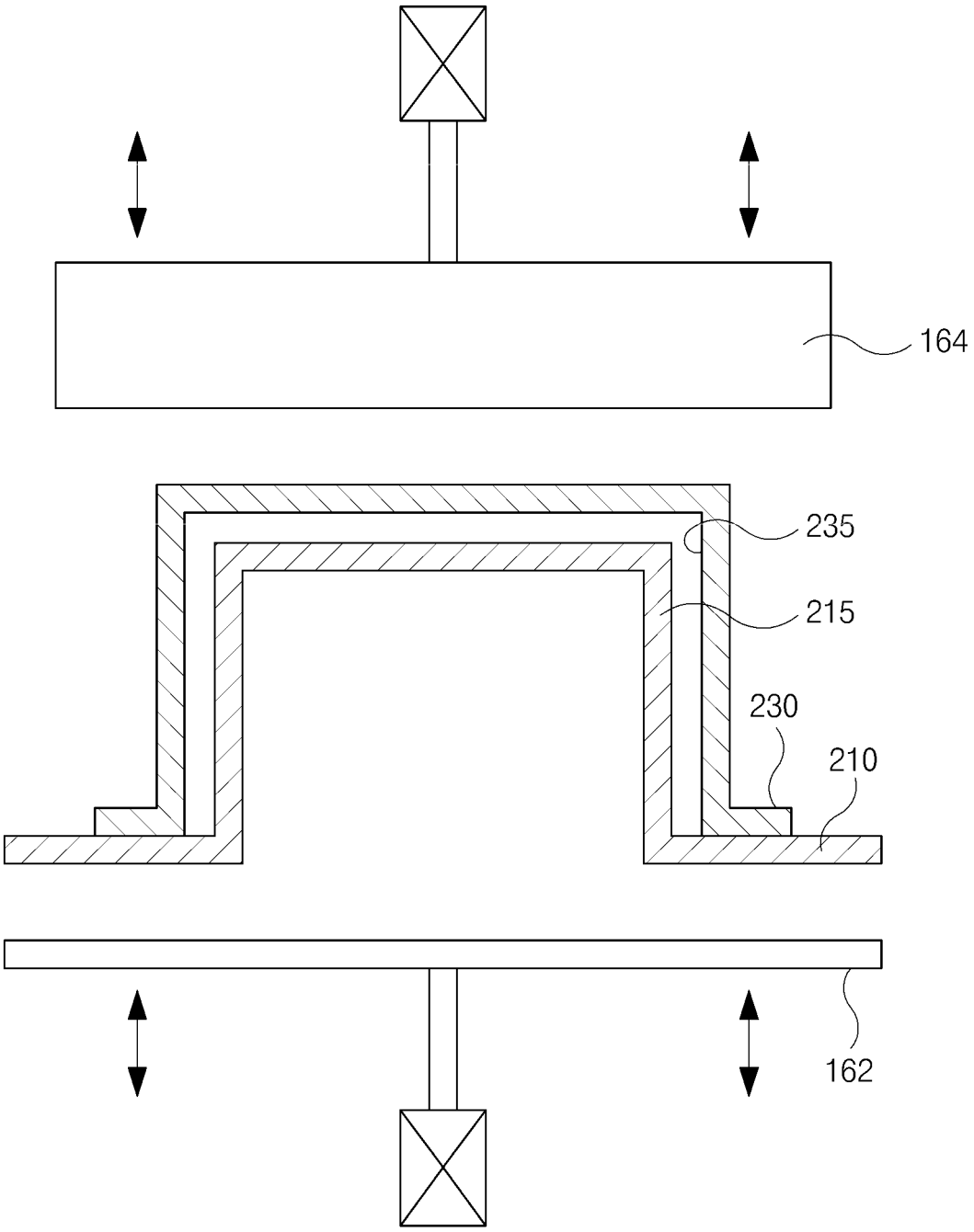
FIG. 10 is a schematic view of the coupling unit shown in FIG. 3.

As illustrated in FIG. 10, the coupling unit 160, which is a press unit composed of a base plate 162, which is vertically movable, and a press plate 164, which is vertically movable, presses the portion, in which the at least one projection 215 is fitted in to the at least one groove 235, between the press plate 164 and the base plate 162, and thus couples the holding plate 230 to the steel plate 210, thereby completing the container upper plate including the handle 220 mounted thereon. In other words, the holding plate 230 and the steel plate 210 are pressed at the fitted portion thereof by means of the press plate 164 and the base plate 162, and are thus firmly coupled to each other. Accordingly, it is possible to firmly couple to the holding plate 230 to the steel plate 210 without an additional adhesive or welding operation.

Figure 11:
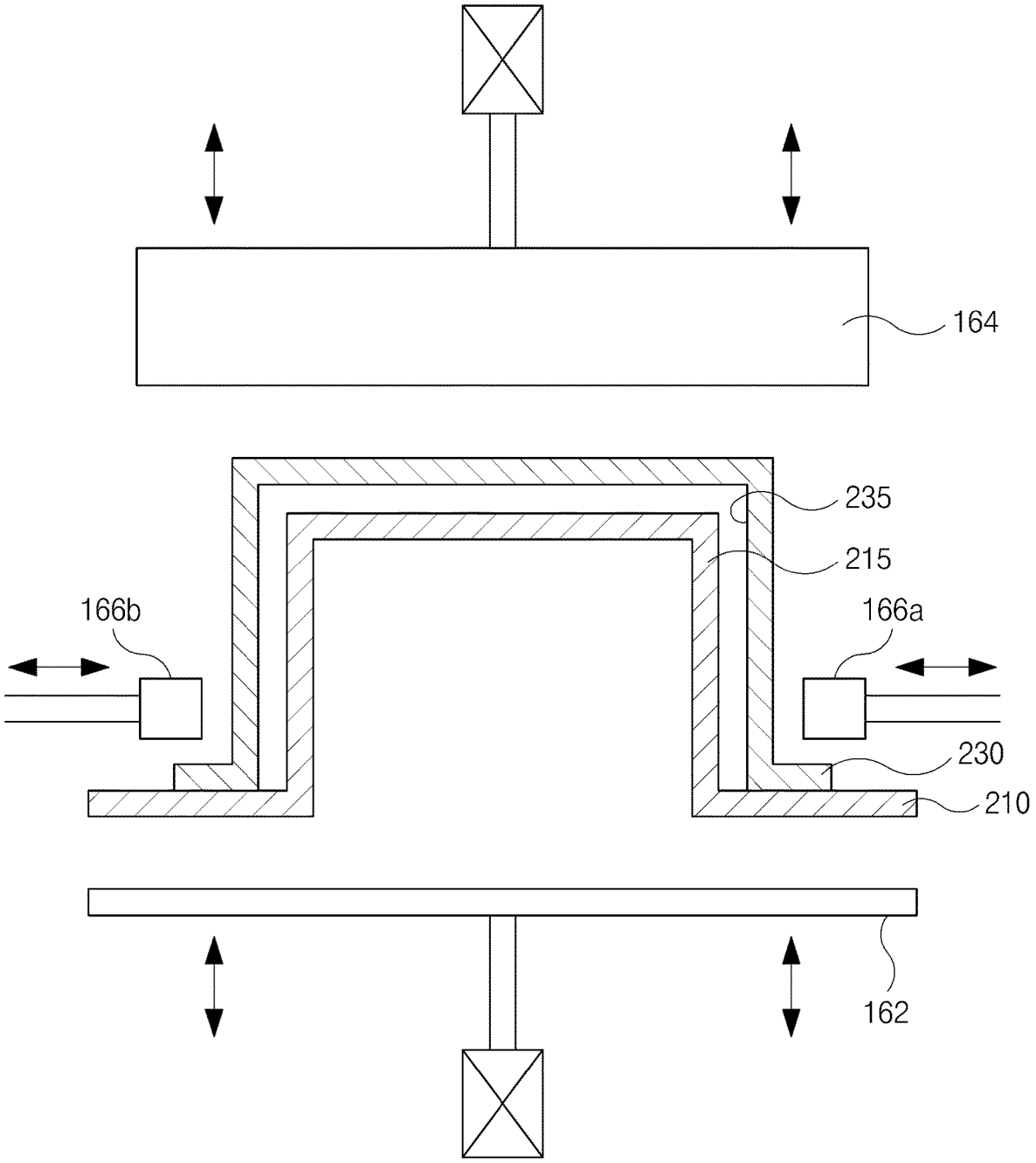
FIG. 11 is a schematic view of the coupling unit, which is further provided with a side press unit.

As illustrated in FIG. 11, the coupling unit 160 may further include a side press unit 166*a* and 166*b* in addition to the press unit, which is composed of the press plate 164 and the base plate 162, so as to provide vertical pressing force.

The side press unit 166*a* and 166*b* is intended to press the lower portion of the fitted portion from both lateral sides thereof in an anteroposterior or lateral direction in the state in which the at least one projection 215 is fitted into the at least one groove 235. In other words, the side press unit 166*a* and 166*b* is intended to press the lower portion of the fitted portion from both lateral sides thereof in an anteroposterior or lateral direction prior to the pressing by means of the press plate 164 and the base plate 162.

Figure 12:
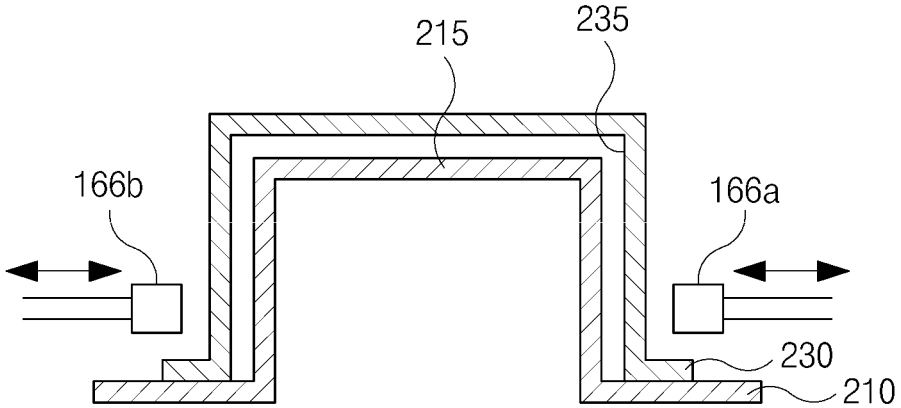
FIG. 12 illustrates cross-sectional views illustrating an operation of pressing the fitted portion by means of the coupling unit shown in FIG. 11 in stages.
Figure 12:
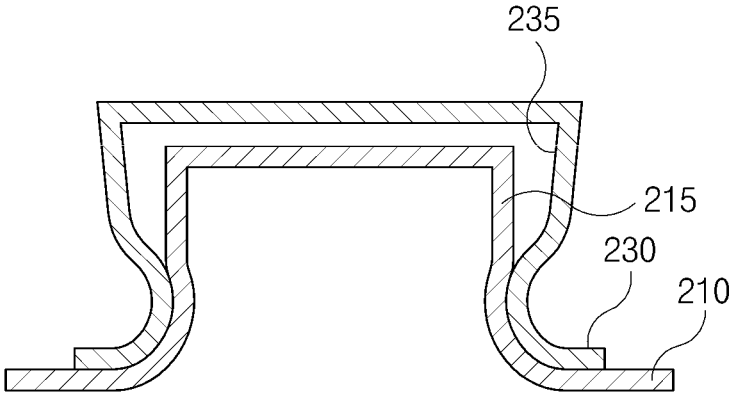
Figure 12:
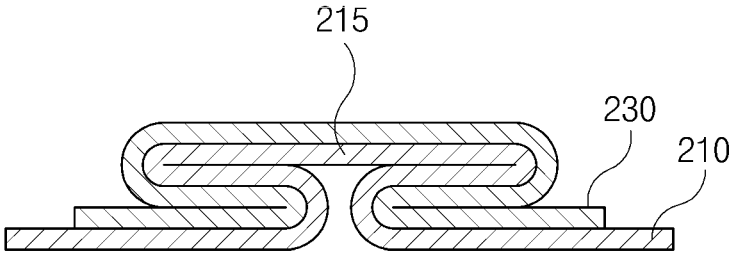

FIG. 12 illustrates the press operation in stages. After the fitted portion, at which the at least one projection 215 is fitted into the at least one groove 235, is disposed between the press plate 164 and the base plate 162, as illustrated in (a) in FIG. 12, the lower portion of the fitted portion is pressed by means of the side press unit 166*a* and 166*b* from both lateral sides thereof in an anteroposterior or lateral direction or from the four sides thereof in anteroposterior or lateral directions. As a result, the width of the lower portion of the fitted portion becomes narrower than the upper portion of the fitted portion, as illustrated in (b) in FIG. 12. Subsequently, when the fitted portion is pressed from above and underneath by means of the press plate 164 and the base plate 162, the fitted portion is pressed and collapsed such that the lower portion of the fitted portion becomes narrow and the upper portion of the fitted portion becomes wide, as illustrated in (c) in FIG. 12. Consequently, it is possible to prevent the at least one projection 215 from being taken out of or separated from the at least one groove 235. In this case, it is possible to realize more firm coupling between the holding plate and the steel plate, compared to the case in which the fitted portion is pressed from above and underneath only by means of the press plate 164 and the base plate 162 shown in FIG. 11.

As described above, since the apparatus 100 for manufacturing a container upper plate according to the embodiment of the present invention is capable of manufacturing a container upper plate by coupling the holding plate 230 including the handle 220 mounted thereto to the steel plate 210 through pressing without using additional means such as adhesive or welding, there are advantages in that problems with the use of welding (corrosion of the container upper plate, decrease in coupling force or the like) are overcome, the coupling force between the handle and the upper plate is increased, and the coupling is facilitated. Furthermore, there is an advantage of efficiently performing the coupling operation by efficiently disposing the units adjacent to each other.

Hereinafter, the process of manufacturing a container upper plate by the apparatus 100 according to the embodiment of the present invention will be briefly described with reference to FIGS. 3 to 12.

In order to manufacture the container upper plate, a preparation operation of preparing the steel plate 210, which is cut to have a predetermined shape and size suitable for the container upper plate, the handle 220 including the grip portion 222 and the fitting portion 224, the holding plate 230, including the reception portion 232, into which the fitting portion 224 of the handle 220 is fitted, and the mounting portion 236, bilaterally extending from the reception portion and coupled to the steel plate 210, is first performed.

If the at least one groove 235 is previously formed in the holding plate 230, an operation of forming the at least one groove 235, which will be described later, may be omitted.

The steel plate 210 is transferred together with other steel plates 210 to the steel-plate-shaping unit 120 from the steel-plate-supply unit 110 by means of the steel-plate-transfer unit in the state in which the steel plate 210 and the other steel plates 210 are maintained at regular intervals. At the same time, the holding plate 230 may be transferred to the holding-plate-shaping unit (not shown).

Subsequently, a steel-plate-shaping operation of forming the at least one projection 215 on the steel plate 210 by means of the steel-plate-shaping unit 120 and a holding-plate-shaping operation of forming the at least one groove 235 in the holding plate 230 by means of the holding-plate-shaping unit are performed. If the at least one groove 235 is previously formed in the holding plate 230, the holding-plate-shaping operation may be omitted.

Here, the steel-plate-shaping unit 120 performs a shaping operation of forming the at least one projection 215, which projects upwards and is recessed into the lower surface thereof, on the steel plate 210, which is transferred by means of the steel-plate-transfer unit.

The steel-plate-shaping operation may perform the shaping of the steel plate 210 using a plurality of metal molds through the initial shaping stage, the intermediate shaping stage and the finish shaping stage, as illustrated in (a) to (d) in FIG. 4.

Alternatively, the shaping operation may also perform the shaping of the steel plate 210 and the shaping of the holding plate 230 through only the finish shaping stage, as illustrated in (d) in FIG. 4.

The at least one projection 214, which is formed through the steel-plate-shaping operation, may include two projections, which are respectively located on both sides of the reference line 212, at which the fitting portion 224 of the handle 220 is fitted, and each of which is configured to have a length thereof greater than a width thereof, as illustrated in (a) in FIG. 6. Alternatively, the at least one projection 214 may include four or more projections, which are arranged at regular intervals on both sides of the reference line 212 and each of which is configured to have a length thereof equal to or almost equal to a width thereof, as illustrated in (b) and (c) in FIG. 6. Furthermore, the projections may be configured to have various shapes and sizes.

The at least one groove 235 may include a plurality of grooves, which correspond to the number and positions of the projections 215 such that the projections are respectively fitted into the grooves 235. For example, the at least one groove 235 may include two grooves 235, which are respectively formed in both sides of the reception portion 232 of the holding plate 230 and each of which is configured to have a length thereof greater than a width thereof, as illustrated in (a) in FIG. 8.

In this case, the at least one groove 235 is configured to have a shape corresponding to the shape of the at least one projection 215 shown in (a) in FIG. 6. The at least one groove 235 may include four or more grooves, which are arranged at regular intervals and each of which is configured to have a length thereof equal to or almost equal to a width thereof, as illustrated in (b) and (c) in FIG. 8. In this case, the at least one groove 235 is configured to have a shape corresponding to the shape of the at least one projection 215 shown in (b) and (c) in FIG. 6. Furthermore, the at least one groove 235 may be configured to have any of various shapes and sizes.

If the at least one groove 235 is previously formed in the holding plate, the groove 235 may be configured to have the structure described with reference to FIG. 8.

Here, the at least one groove 235 must be configured to have an inside width or an inside diameter equal to or larger than the outside width or the outside diameter of the at least one projection 215. When the inside width or the inside diameter of the at least one groove 235 is equal to the outside width or the outside diameter of the at least one projection 215, the at least one projection 215 must be forcibly fitted into the at least one groove 235 using strong force. In contrast, when the inside width or the inside diameter of the at least one groove 235 is larger than the outside width or the outside diameter of the at least one projection 215, the at least one projection 215 is easily fitted into the at least one groove 235.

As illustrated in (a) in FIG. 9, the at least one groove 235 may be configured to have a rectangular section, which has a constant width or inside diameter, so as to correspond to the shape of the at least one projection 215. Alternatively, as illustrated in (b) in FIG. 9, the at least one groove 235 may be configured to have an inverted trapezoidal shape or an inverted triangular shape, the width or the inside diameter of which increases with increasing distance inwards from the inlet. In this case, the at least one projection 215 may be configured to have a rectangular section having a constant width or inside diameter. In the case in which the at least one groove 235 and the at least one projection 215 are formed as illustrated in (b) in FIG. 9, the width or the inside diameter of the at least one groove 235 at the inlet thereof must be slightly larger than the width of the inside diameter of the at least one projection 215. Furthermore, in the case in which the at least one groove 235 and the at least one projection 215 are formed as illustrated in (b) in FIG. 9, when the at least one projection 215 and the at least one groove 235 are pressed in the state in which the at least one projection 215 is fitted into the at least one groove 235, it is possible to realize more secure coupling therebetween.

Subsequently, the steel plate 210 and the holding plate 230 are transferred to the loading unit 150, at which a loading operation is performed.

The loading operation is performed so as to load the holding plate 230 onto the steel plate 210 by fitting the at least one projection 215 formed on the steel plate 210 into the at least one groove 235 formed in the holding plate 230, as illustrated in (a) and (b) in FIG. 9.

After the loading operation, a coupling operation is performed.

The coupling operation is performed so as to press and couple the holding plate 230 to the steel plate 210 by pressing the fitted portion from above and underneath by means of the press plate in the state in which the holding plate 230 is loaded onto the steel plate 210 such that the at least one projection 215 formed on the steel plate 210 is fitted into the at least one groove 235 formed in the holding plate 230 through the loading operation. In other words, the coupling operation is performed so as to press and couple the holding plate 230 to the steel plate 210 by pressing the fitted portion by means of the coupling unit 160, thereby manufacturing the container upper plate including the handle 220 mounted thereon, as illustrated in FIG. 10. Accordingly, it is possible to realize firm coupling between the holding plate 230 and the steel plate 210 without using additional adhesive or welding.

Furthermore, a side press operation may be further performed prior to or simultaneously with the coupling operation, as illustrated in FIG. 11.

The side press operation is intended to press the lower portion of the fitted portion from both lateral sides thereof in an anteroposterior or lateral direction in the state in which the at least one projection 215 of the steel plate 210 is fitted into the at least one groove 235 in the holding plate 230. In other words, the side press operation is performed so as to press the lower portion of the fitted portion from both lateral sides thereof in an anteroposterior or lateral direction before pressing the fitted portion from above and underneath by means of the press plate in the coupling operation. Although the side press operation is preferably performed before pressing the fitted portion from above and underneath by means of the press plate in the coupling operation, the side press operation may also be performed simultaneously with the vertical pressing by means of the press plate.

FIG. 12 illustrates the press operation in stages. After the fitted portion, at which the at least one projection 215 is fitted into the at least one groove 235, is disposed between the press plate 164 and the base plate 162, as illustrated in (a) in FIG. 12, the lower portion of the fitted portion is pressed by means of the side press unit 166*a* and 166*b* from both lateral sides thereof in an anteroposterior or lateral direction or from the four sides thereof in anteroposterior or lateral directions. As a result, the width of the lower portion of the fitted portion becomes narrower than the upper portion of the fitted portion, as illustrated in (b) in FIG. 12. Subsequently, when the fitted portion is pressed from above and underneath by means of the press plate 164 and the base plate 162, the fitted portion is pressed and collapsed such that the lower portion of the fitted portion is narrow and the upper portion of the fitted portion is wide, as illustrated in (c) in FIG. 12. Consequently, it is possible to prevent the at least one projection 215 from being taken out of or separated from the at least one groove 235. In this case, it is possible to realize more firm coupling between the holding plate and the steel plate, compared to the case in which the fitted portion is pressed from above and underneath only by means of the press plate 164 and the base plate 162 shown in FIG. 11.

Figure 13:
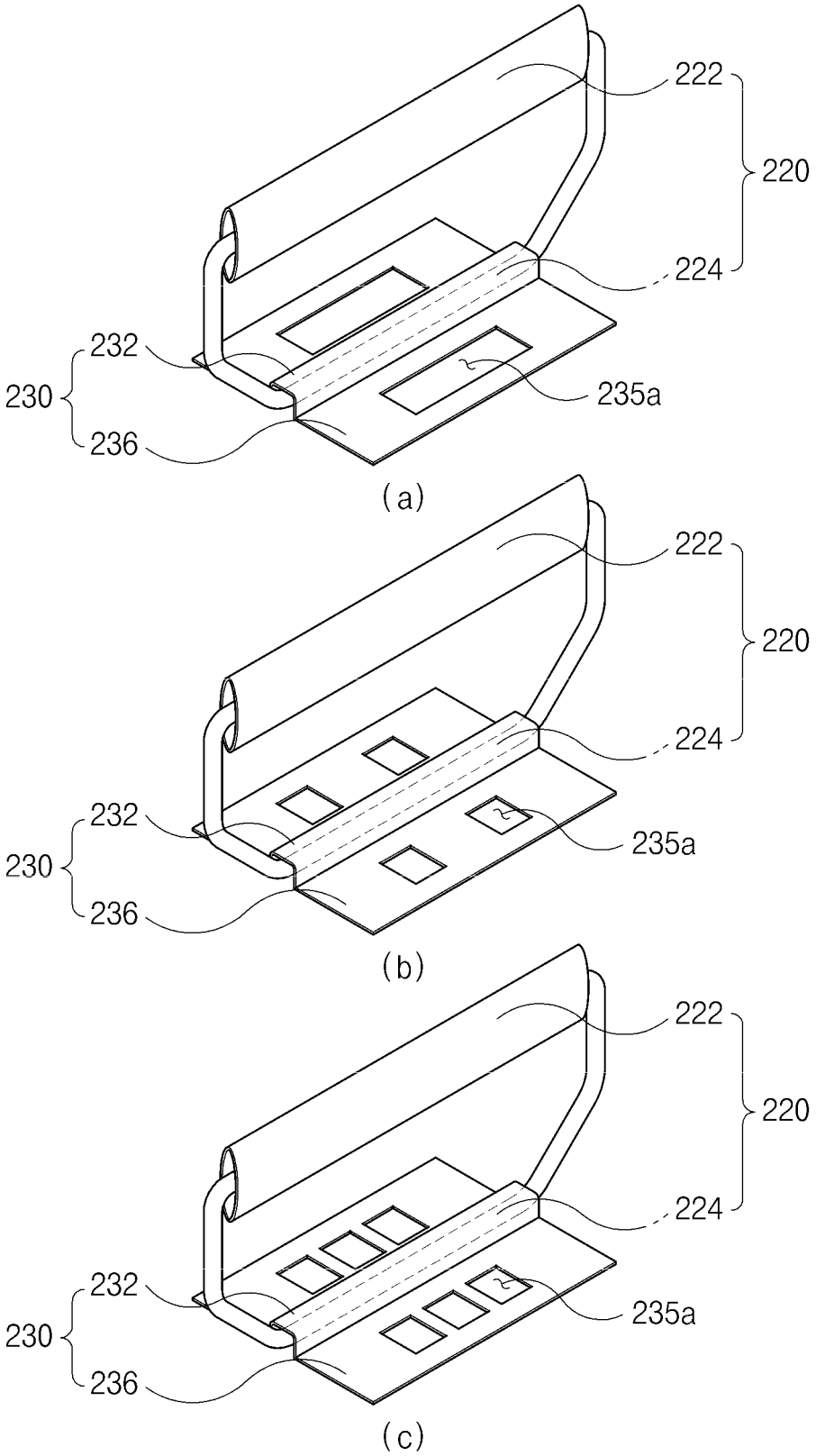
FIG. 13 illustrates perspective views of holding plates, each of which is provided therein with at least one hole.
Figure 14:
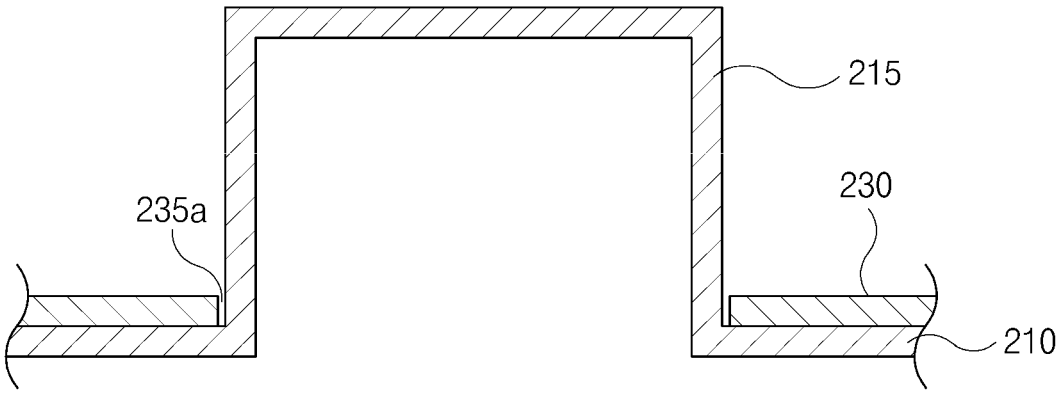
FIG. 14 is a cross-sectional view of a fitted portion at which the projection is fitted into the hole when the holding plate is loaded onto the steel plate.
Figure 15:
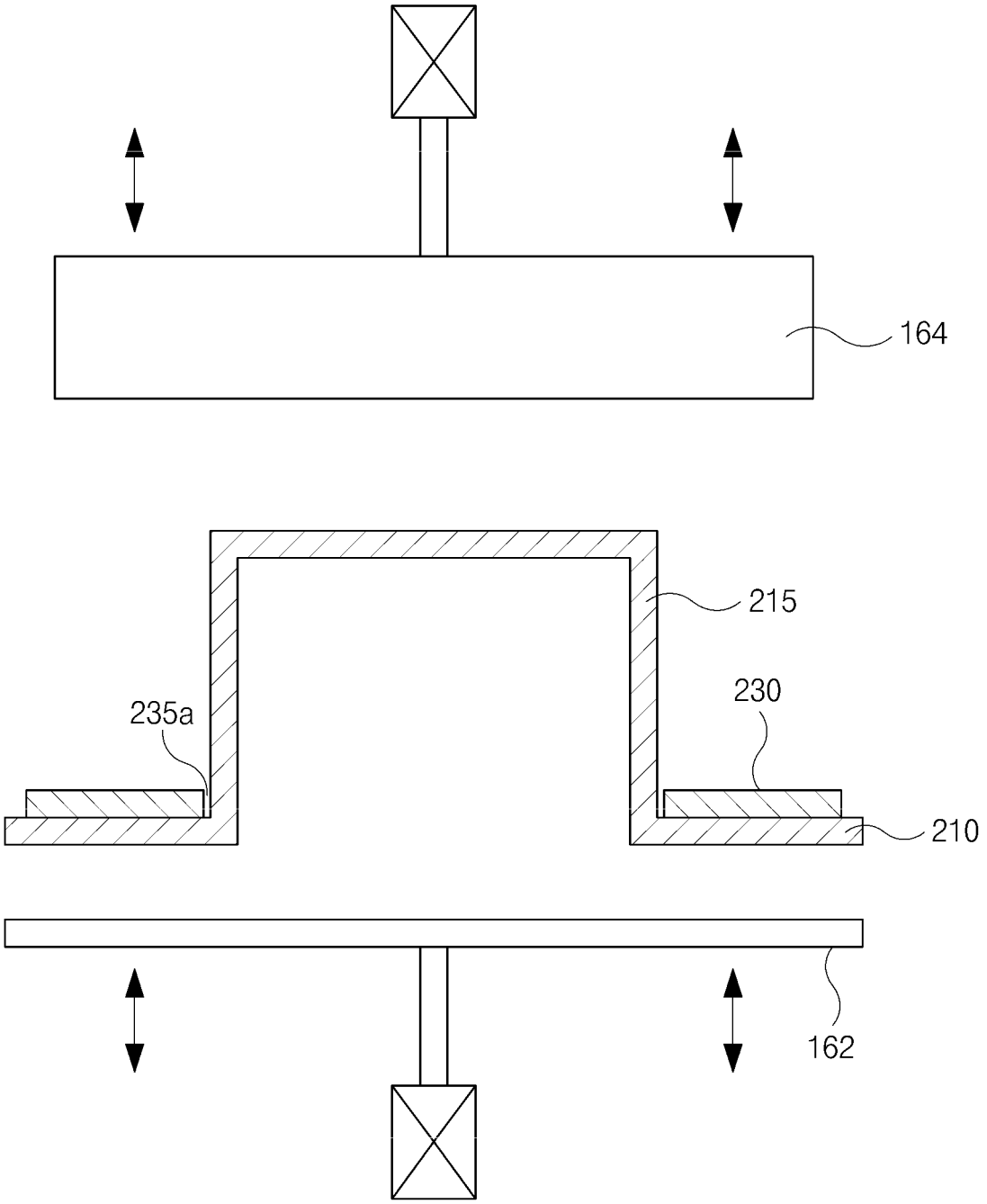
FIG. 15 is a schematic view illustrating an operation of pressing the fitted portion by means of the coupling unit shown in FIG. 3.
Figure 16:
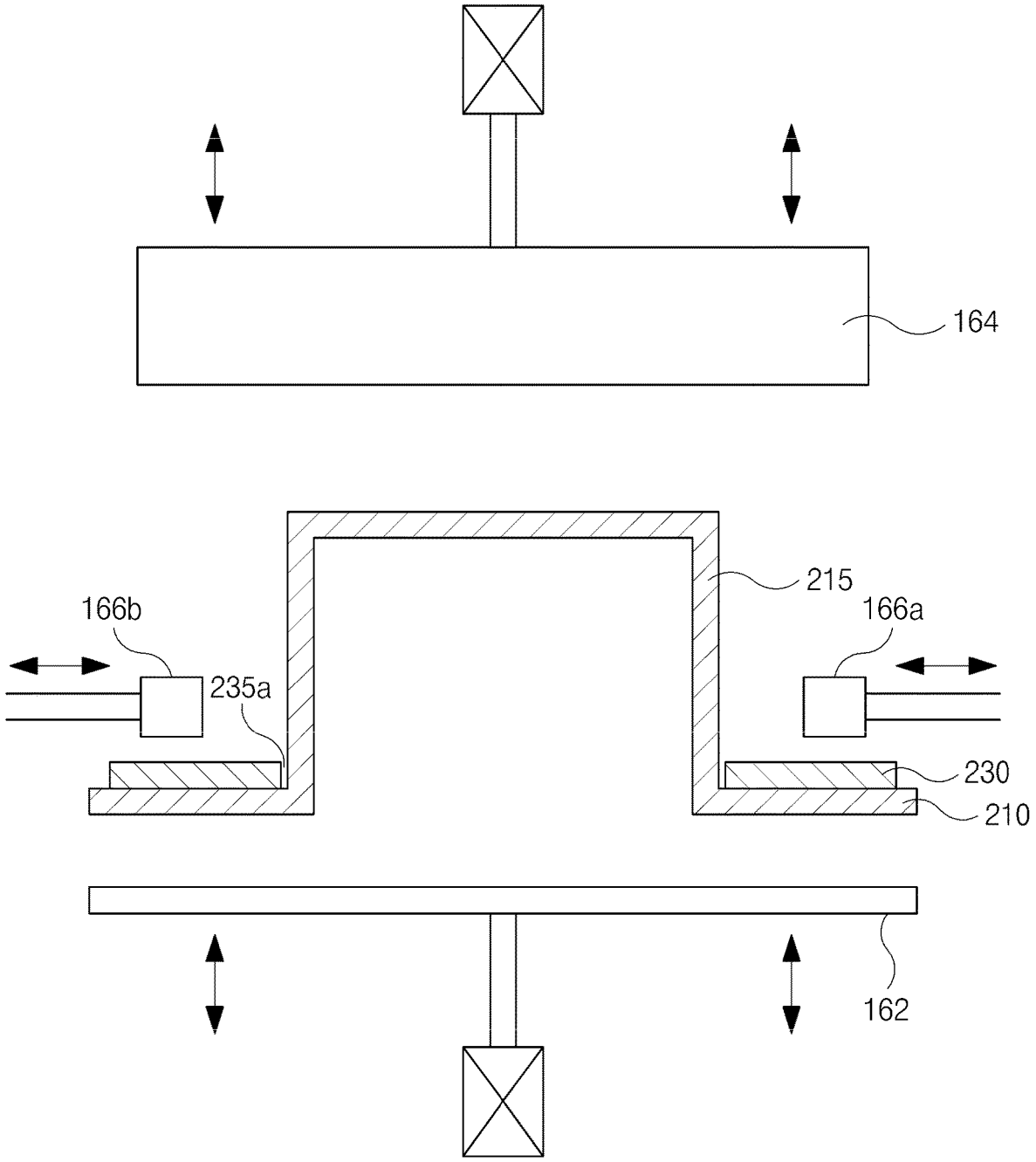
FIG. 16 is a schematic view illustrating an operation of pressing the fitted portion by means of the coupling unit, which is further provided with a side press unit.
Figure 17:
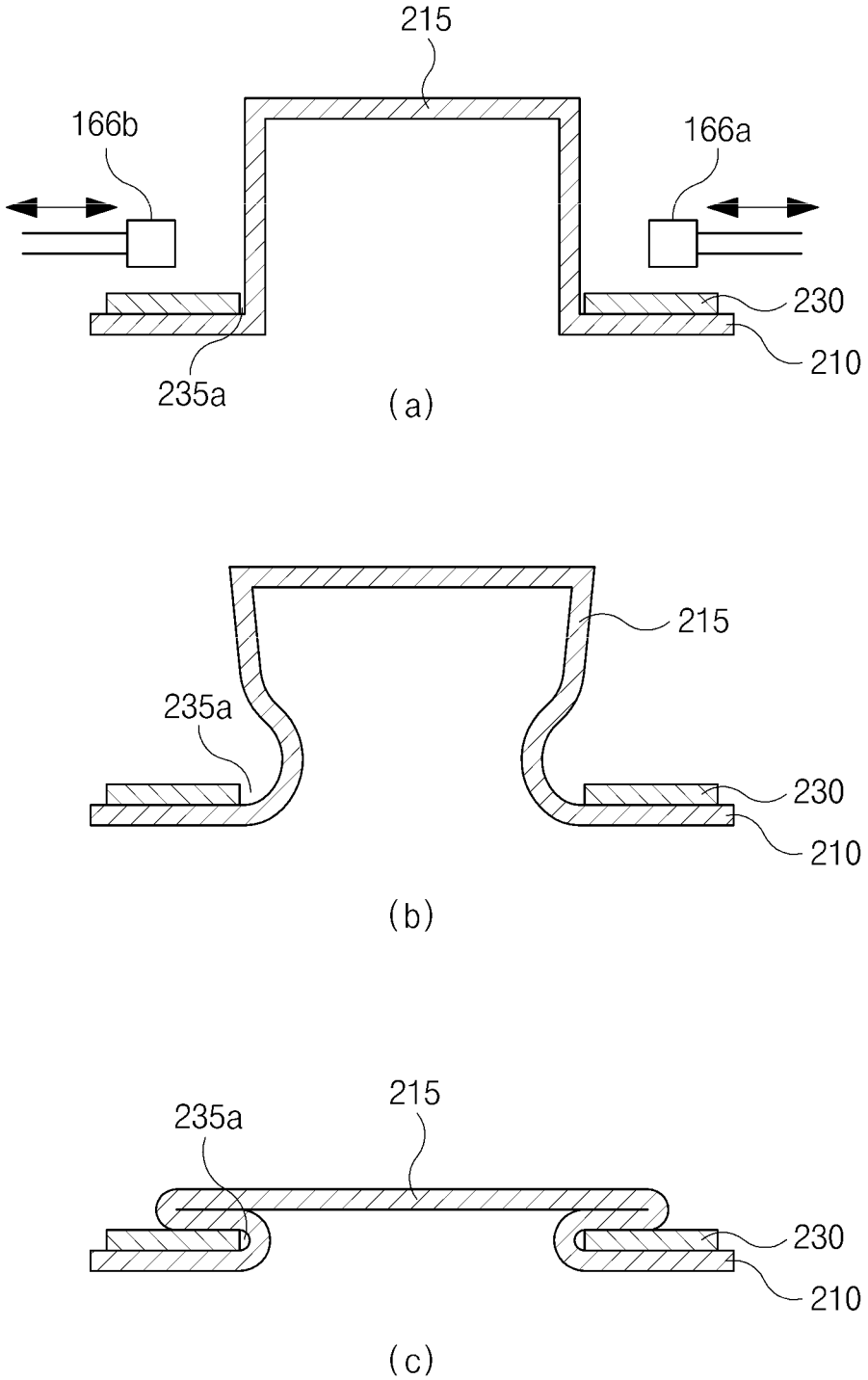
FIG. 17 illustrates cross-sectional views illustrating the operation of pressing the fitted portion by means of the coupling unit, in stages.

FIGS. 13 to 17 illustrate a process of manufacturing a container upper plate by the apparatus 100 according to another embodiment of the present invention. FIG. 13 illustrates perspective views of a holding plate having therein at least one hole. FIG. 14 is a cross-sectional view of a fitted portion, at which the projection is fitted into the hole, in the state in which the holding plate is loaded onto the steel plate. FIG. 15 is a schematic view illustrating an operation of pressing the fitted portion by means of the coupling unit. FIG. 16 is a schematic view illustrating the operation of pressing the fitted portion by means of the coupling unit, which is further provided with the side press unit. FIG. 17 illustrates cross-sectional views illustrating the operation of pressing the fitted portion by means of the coupling unit shown in FIG. 16.

In the embodiment shown in FIGS. 3 to 12, the at least one groove 125 is formed in the holding plate 230, the at least one projection 215 formed on the steel plate 210 is fitted into the at least one groove 235, and the fitted portion is pressed, thereby coupling the holding plate 230 to the steel plate 210. Meanwhile, in another embodiment shown in FIGS. 13 to 17, the at least one hole 235*a* is formed in the mounting portion 236 of the holding plate 230, the at least one projection 215 formed on the steel plate 210 is fitted into the at least one hole 235*a*, and the fitted portion is pressed, thereby coupling the holding plate 230 to the steel plate 210.

According to this embodiment, it is possible to couple the holding plate 230 to the steel plate 210 more simply and inexpensively by forming the hole in the holding plate 230, in place of the groove.

More specifically, in order to manufacture the container upper plate, a preparation operation of preparing the steel plate 210, which is cut to have a predetermined shape and size suitable for the container upper plate, the handle 220 including the grip portion 222 and the fitting portion 224, and the holding plate 230 including the reception portion 232, into which the fitting portion 224 of the handle 220 is fitted, and the mounting portion 236, bilaterally extending from the reception portion and coupled to the steel plate 210, is first performed.

Subsequently, a steel-plate-shaping operation of forming the at least one projection 215 on the steel plate 210 by means of the steel-plate-shaping unit 120 and a holding-plate-shaping operation of forming the at least one groove 235 in the holding plate 230 by means of the holding-plate-shaping unit are performed. If the at least one groove 235 is previously formed in the holding plate 230, the holding-plate-shaping operation may be omitted.

The operation of forming the at least one projection 215 on the steel plate 210 is the same as the operation described with reference to FIGS. 3 to 12 (particularly FIG. 4). The holding plate 235 is provided with the at least one hole 235*a*, in place of the at least one groove 235 shown in FIG. 8, which is formed at the same location as the at least one groove 235. If the at least one hole 235*a* is previously formed in the holding plate 230, the operation of forming the at least one hole 235*a*, which will be described later, may be omitted. Here, the holding-plate-shaping unit must be optimally configured so as to form the groove or the hole because the groove must be formed in the embodiment shown in FIG. 8 and the hole must be formed in the embodiment shown in FIG. 13.

The at least one hole 235*a* is configured such that the number and position of the at least one hole 235 correspond to those of the at least one projection 215, and has a shape corresponding to the at least one projection 215 such that the at least one projection 215 is fitted into the at least one hole 235*a*.

For example, the at least one hole 232 may include two grooves, which are formed in both sides of the reception portion 232 of the holding plate 230 and each of which is configured such that the length thereof is greater than the width thereof, as illustrated in (a) in FIG. 13. In this case, the at least one hole 235*a* is configured to correspond to the at least one projection 215 shown in (a) in FIG. 6.

Alternatively, the at least one hole 235*a* may include four or more grooves, which are arranged at regular intervals and each of which is configured to have the same or almost the same width and length, as illustrated in (b) and (c) in FIG. 13. In this case, the at least one hole 235*a* is configured to correspond to the at least one projection 215, which has the shape shown in (b) and (c) in FIG. 6. The at least one hole 235*a* may be configured to have any of various shapes and sizes.

If the at least one hole 235*a* is previously formed in the holding plate, the hole 235*a* may be configured to have the structure described with reference to FIG. 8.

Here, the at least one hole 235*a* must be configured to have an inside width or an inside diameter equal to or larger than the outside width or outside diameter of the at least one projection 215.

As illustrated in FIGS. 13 and 14, the at least one hole 235*a* may be configured to have a rectangular section, which has a constant width or inside diameter, so as to correspond to the shape of the at least one projection 215. In this case, the at least one projection 215 may be configured to have a rectangular section having a constant width or inside diameter.

Subsequently, the steel plate 210 and the holding plate 230 are transferred to the loading unit 150, at which a loading operation is performed.

The loading operation is performed so as to load the holding plate 230 onto the steel plate 210 by fitting the at least one projection 215 formed on the steel plate 210 into the at least one hole 235*a* formed in the holding plate 230, as illustrated in FIG. 14.

After the loading operation, a coupling operation is performed.

The coupling operation is performed so as to press and couple the holding plate 230 to the steel plate 210 by pressing the fitted portion from above and underneath by means of the press plate in the state in which the holding plate 230 is loaded onto the steel plate 210 such that the at least one projection 215 formed on the steel plate 210 is fitted into the at least one hole 235*a* formed in the holding plate 230 through the loading operation. In other words, the coupling operation is performed so as to press and couple the holding plate 230 to the steel plate 210 by pressing the fitted portion by means of the coupling unit 160, thereby manufacturing the container upper plate including the handle 220 mounted thereon, as illustrated in FIG. 15. Accordingly, it is possible to realize firm coupling between the holding plate 230 and the steel plate 210 without using an additional adhesive or welding.

Furthermore, the side press operation may be further performed prior to or simultaneously with the coupling operation, as illustrated in FIG. 16.

The side press operation is intended to press the lower portion of the fitted portion from both lateral sides thereof in an anteroposterior or lateral direction in the state in which the at least one projection 215 of the steel plate 210 is fitted into the at least one hole 235*a* in the holding plate 230. In other words, the side press operation is performed so as to press the lower portion of the fitted portion from both lateral sides thereof in an anteroposterior or lateral direction before pressing the fitted portion from above and underneath by means of the press plate in the coupling operation. Although the side press operation is preferably performed before pressing the fitted portion from above and underneath by means of the press plate in the coupling operation, the side press operation may also be performed simultaneously with the vertical pressing by means of the press plate.

FIG. 17 illustrates the press operation in stages. After the fitted portion, at which the at least one projection 215 is fitted into the at least one hole 235*a*, is disposed between the press plate 164 and the base plate 162, as illustrated in (a) in FIG. 17, the lower portion of the fitted portion is pressed by means of the side press unit 166*a* and 166*b* from both lateral sides thereof in an anteroposterior or lateral direction or from the four sides thereof in anteroposterior or lateral directions. As a result, the width of the lower portion of the fitted portion becomes narrower than the width of the upper portion of the fitted portion, as illustrated in (b) in FIG. 17. Subsequently, when the fitted portion is pressed from above and underneath by means of the press plate 164 and the base plate 162, the fitted portion is pressed and collapsed such that the lower portion of the fitted portion is narrow and the upper portion of the fitted portion is wide, as illustrated in (c) in FIG. 17. Consequently, it is possible to prevent the at least one projection 215 from being taken out of or separated from the at least one hole 235*a*. In this case, it is possible to realize more firm coupling between the holding plate and the steel plate, compared to the case in which the fitted portion is pressed from above and underneath only by means of the press plate 164 and the base plate 162 shown in FIG. 15.

As described above, since the process of manufacturing a container upper plate according to the embodiment of the present invention is capable of manufacturing a container upper plate through pressing without using additional means such as adhesive or welding, there are advantages in that problems with use of welding (corrosion of the container upper plate, decreased coupling force or the like) are overcome, the coupling force between the handle and the upper plate is increased, and the coupling is facilitated. Furthermore, there is an advantage of efficiently performing the coupling operation by efficiently disposing the units adjacent to each other.

Because the descriptions of the embodiments of the present invention are only examples provided with reference to the drawings for thorough understanding of the preferred embodiments of the present invention, the descriptions should not be construed as limiting the present invention. It will be apparent to those skilled in the art to which the present invention belongs that various modifications and variations can be made without exceeding the spirit and scope of the present invention.

The invention claimed is:

1. A method of manufacturing a container upper plate including a handle coupled thereto, the method comprising:

providing a steel plate having a predetermined shape, a handle including a grip portion and a fitting portion, and a holding plate including a reception portion and a mounting portion extending bilaterally from the reception portion;

forming at least one projection, which projects upwards from a coupling region of the steel plate to which the mounting portion is coupled, on the steel plate, thereby shaping the steel plate;

loading the holding plate onto the steel plate such that the fitting portion of the handle is fitted into the reception portion of the holding plate and such that the at least one projection on the steel plate is fitted into at least one groove or hole formed in the mounting portion; and coupling the holding plate to the steel plate under pressure by pressing a fitted portion, at which the at least one projection is fitted into the at least one groove or hole, from above and underneath.

2. The method according to claim 1, wherein the at least one groove has an inside width or an inside diameter equal to or larger than an outside width or an outside diameter of the at least one projection.

3. The method according to claim 2, wherein the at least one groove has a rectangular section having a constant inside width or inside diameter.

4. The method according to claim 3, wherein the at least one groove or the at least one hole is formed simultaneously with formation of the holding plate in the preparing the holding plate or is formed through an additional shaping operation after the formation of the holding plate.

5. The method according to claim 3, further comprising, between loading of the holding plate and coupling of the holding plate, pressing a lower portion of the fitted portion from both lateral sides thereof in a state in which the at least one projection is fitted into the at least one groove or the at least one hole.

6. The method according to claim 2, wherein the at least one groove has an inverted trapezoidal shape or an inverted triangular shape, an inside width or an inside diameter of which increases with increasing distance inwards from an inlet thereof.

7. The method according to claim 6, wherein the at least one groove or the at least one hole is formed simultaneously with formation of the holding plate in the preparing the holding plate or is formed through an additional shaping operation after the formation of the holding plate.

8. The method according to claim 6, further comprising, between loading of the holding plate and coupling of the holding plate, pressing a lower portion of the fitted portion from both lateral sides thereof in a state in which the at least one projection is fitted into the at least one groove or the at least one hole.

9. The method according to claim 1, wherein the forming includes:

preparing at least one lower metal mold, which includes at least one protrusion and is vertically movable, and an upper metal mold, which has therein at least one guide groove, into which the at least one protrusion is fitted, and is vertically movable;

disposing the steel plate between the upper metal mold and the lower metal mold and pressing the steel plate to form the at least one projection, in a state in which sizes of the protrusion and the guide groove are set to be larger than a desired size;

pressing the steel plate in a state in which the sizes of the protrusion and the guide groove are set to be smaller than those in the initial shaping operation but to be larger than the desired size; and pressing the steel plate in a state in which the sizes of the protrusion and the guide groove are set to be equal to the desired size.

10. The method according to claim 9, wherein the forming is performed in stages between lower metal molds and upper metal molds in which the sizes of the protrusion on the lower metal molds and the guide groove in the upper metal molds are sequentially reduced.

11. The method according to claim 1, wherein the steel plate is selected from among a tin-plated steel plate, a cold-rolled steel plate, a chrome-plated steel plate, a tin-plated steel plate coated with a protective film, a cold-rolled steel plate coated with a protective film and a chrome-plated steel plate coated with a protective film.

* * * * *